US007556280B2

(12) United States Patent
Holzer

(10) Patent No.: US 7,556,280 B2
(45) Date of Patent: Jul. 7, 2009

(54) BINDING MECHANISM FOR PROVIDING A PIVOTING CONNECTION FOR A SPORTS SHOE TO A BOARD-TYPE GLIDING DEVICE

(75) Inventor: Helmut Holzer, St. Johann (AT)

(73) Assignee: ATOMIC Austria GmbH, Altenmarkt im Pongau (AT)

( * ) Notice: Subject to any disclaimer, the term of this patent is extended or adjusted under 35 U.S.C. 154(b) by 641 days.

(21) Appl. No.: 11/429,617

(22) Filed: May 5, 2006

(65) Prior Publication Data

US 2006/0249929 A1 Nov. 9, 2006

(30) Foreign Application Priority Data

May 6, 2005 (AT) ..... A 774/2005

(51) Int. Cl.
*A63C 9/00* (2006.01)

(52) U.S. Cl. ..... 280/615; 280/611; 280/11.3; 280/841; 280/7.13; 280/7.1

(58) Field of Classification Search ..... 280/615, 280/611, 11.3, 841, 7.13, 712, 7.1
See application file for complete search history.

(56) References Cited

U.S. PATENT DOCUMENTS 6,267,403 B1 * 7/2001 Bossin et al. ..... 280/625
6,308,979 B1 * 10/2001 Ludlow ..... 280/615
6,685,213 B2 * 2/2004 Hauglin ..... 280/624
6,773,024 B2 * 8/2004 Walkhoff ..... 280/613
6,964,428 B2 * 11/2005 Quellais et al. ..... 280/615

FOREIGN PATENT DOCUMENTS

EP 0 904 809 B1 3/1999
WO WO 98/58710 12/1998
WO WO 00/29076 5/2000

* cited by examiner

*Primary Examiner*—Christopher P Ellis
*Assistant Examiner*—Cynthia F Collado
(74) *Attorney, Agent, or Firm*—Collard & Roe, P.C.

(57) ABSTRACT

The invention describes a binding mechanism (1) for providing a pivotably moving connection of a sports shoe (2) to a board-type gliding device (3), in particular to a ski (4). The binding mechanism (1) comprises a first or front retaining element (5) for retaining the front toe-end portion of a sports shoe (2), a second or rear retaining element (6) for retaining the rear heel-end portion of a sports shoe (2) and an elongate connecting element (9) of variable shape between the first and the second retaining element (5, 6). This connecting element (9) extends underneath the sole (10) of a sports shoe (2) inserted in the binding mechanism (1). The connecting element (9) is provided in the form of a link chain (12) with a plurality of connected link parts (13) and the individual link parts (13) are articulatingly connecting to one another by means of several link joints (14) with several articulation axes(16) oriented parallel with one another, and the articulation axes (16) of the link joints (14) are oriented essentially horizontally and extend transversely to the longitudinal extension of the connecting element (9) and transversely to the binding longitudinal axis (15).

44 Claims, 9 Drawing Sheets

BINDING MECHANISM FOR PROVIDING A PIVOTING CONNECTION FOR A SPORTS SHOE TO A BOARD-TYPE GLIDING DEVICE

CROSS REFERENCE TO RELATED APPLICATIONS

Applicant claims priority under 35 U.S.C. § 119 of AUSTRIAN Patent Application No. A 774/2005 filed on May 6, 2005.

BACKGROUND OF THE INVENTION

1. Field of the Invention

The invention relates to a binding mechanism for providing a pivoting connection for a sports shoe to a board-type gliding device, in particular to a ski, which binding mechanism, in order to provide a pivoting connection for a sports shoe to a board-type gliding device, in particular to a ski, has a first or front retaining element for retaining the font, toe-end portion of a sports shoe, a second or rear retaining element for retaining the rear heel-end portion of a sports shoe, and an elongate connecting element of variable shape between the first and the second retaining element, which connecting element extends underneath the sole of a sports shoe inserted in the binding mechanism.

2. The Prior Art

Patent specification WO 98/58710 A1, for example, discloses a binding mechanism, by means of which a sports shoe can be mounted so as to pivot relative to a ski. This binding mechanism, provided in the form of a touring or telemark binding, comprises a front retaining element for retaining the shoe toe region of a sports shoe and a rear retaining or coupling element for providing a connection to the heel-end portion of a sports shoe. The toe-end retaining element and the heel-end retaining element in this instance are connected to one another by means of a fixed plate. Disposed in the front end portion of this connecting plate is an articulated link extending transversely to the binding longitudinal axis and essentially parallel with the standing plane. This articulated link is disposed directly underneath a bending point of the sports shoe so that the ski binding bends underneath the heel of the foot. This binding mechanism is intended to enable an efficient transfer of force and stability between the user and the ski. The plate connection between the front and rear retaining element is also intended to prevent lateral deviating movements relative to the ski as far as possible and is so above all whenever the heel portion is raised relative to the toe portion during walking movements. Although the walking properties are improved due to the fact that the pivot axis is set back from the tip of the foot, a satisfactory or as natural as possible a walking sequence is nevertheless not possible, even with this binding mechanism.

Patent specification WO 00/29076 A1 filed by this same applicant also discloses a pivotable connecting mechanism for mounting between a sports device and a standing surface of a shoe for a foot of a user. In this instance, the standing surface can be pivoted about an axis extending more or less parallel with the ankle joint of the foot and a part region associated with the toe-region can be moved into a position closer to the sports device. To this end, the sole of the sports shoe rests on a roll-off body with an arcuate, downwardly curved roll-off surface. The standing surface or the sole of the sports shoe in this instance is connected at the front toe-end portion to the roll-off body on the sports device by means of a flexible connecting element which is deformable and able to rebound within a vertical plane. It was also proposed that the connecting element, which constitutes the sole connection between the front part-portion of the sports shoe and the sports device, should be provided in the form of a strap incorporating members, comprising members which can be pivoted relative to the vertical direction and restricted by stops. In particular, the strap of members can be moved in only one direction starting from a longitudinally extended position, in which it is restricted by stops, into a downwardly curved position towards the sports device. Starting from the roll-off body, upwards in the vertical direction, a stop restrictor or an anti-lifting lock is therefore provided, by means of which the connecting element can not be bent upwards beyond a straight orientation. A relative natural motion sequence can be simulated with this flexible connecting element similar to the shape of the roll-off body. To enable the connecting element to effect a downward pivoting movement, however, a roll-body needs to be provided on the sports device which enables a displacement of the toe-end portion of the sports shoe downwards in the direction towards the top face of the sports device. This places high demands on the end-face connecting points of the connecting element with respect to the sports shoe or with respect to the roll-off body, which are subjected to a large amount of stress.

Patent specification EP 0 904 809 A1 filed by this applicant describes another pivotable connecting mechanism between a sports device and a standing surface for a foot of a user. In this instance, the standing surface for the foot of the user is connected to the sports device by means of an articulated link with two transmitting arms extending at an angle and in opposite directions. The end portions of these transmitting arms are connected by articulated joints to the standing surface on the one hand and to the sports device on the other hand. This articulated link permits an advantageous motion coupling between the sports shoe or standing surface and the board-type sports device. The flexibility of the shoe sole or the sports shoe plays only a subordinate role with respect to this binding mechanism.

SUMMARY OF THE INVENTION

The underlying objective of the present invention is to propose a pivotable connecting mechanism between a sports shoe and a board-type gliding device, which is improved in terms of permitting the most natural possible walking or running motion sequences but nevertheless enables an exact control of the board-type gliding device.

This objective is achieved by the invention on the basis of a binding mechanism whereby the connecting element is provided in the form of a link chain with a plurality of connected link parts, and the individual link parts are articulatingly connected to one another by means of several articulated connections which form several articulation axes oriented parallel with one an other, and the articulation axes of the articulated connections are essentially horizontally oriented and extend transversely to the longitudinal extension of the connecting element and transversely to the binding longitudinal axis.

Since the intrinsic flexibility of the sports shoe or its sole is barely or only slightly impaired by the binding mechanism, the specifically intended flexibility and the usage properties of the sports shoe, optimised on the basis of numerous testes and developments, can be made use of at least to a large extent to produce a walking or running motion sequence which corresponds as far as possible to the physiological sequences during use of the binding mechanism proposed by the invention. In particular, full use can be made of the performance of the sports shoe and, depending on the properties of the respective sports shoe, the usage behaviour of the combination of sports articles comprising the shoe, binding and gliding device can be positively influenced or varied in a very simple manner. This may be achieved by a simple variation in the shoe settings or by selecting an appropriate pair of shoes with greater flexibility or a higher stiffness. As a result, the binding mechanism proposed by the invention can be adapted to suit individual wishes or changing usage conditions without the need for complex adjusting mechanisms on the actual binding mechanism—which would detrimentally increase the weight and the cost of the binding mechanism. Depending on the number of articulation axes or depending on the length of the individual link parts of the connecting element, the connecting element and the corresponding link chain can be adapted or moulded more or less exactly to the curvatures of the shoe sole which occur. In principle, the connecting element comprising several articulation axes is able to perform and likewise effect virtually any deformation and rebound movements of the sports shoe, in particular bending of the sole, in a corresponding manner. The performance ability of the user can be increased due to the relatively natural motion sequence which can be achieved with the binding mechanism proposed by the invention during ski treks, telemark turns, cross-country activities or similar, thereby increasing comfort during use. In particular, the binding mechanism proposed by the invention no longer rules out the criteria of high comfort during usage and improved performance. What is of particular advantage in the case of the binding mechanism proposed by the invention is the fact that in spite of high flexibility in terms of bending and curved deformations, force can be efficiently transmitted from the user's foot to the board-type sports or gliding device and vice versa. Especially due to the specified connecting element with clearly defined articulation axes, force can be efficiently transmitted from the rear retaining element in the direction towards the front retaining element and vice versa. The binding mechanism proposed by the invention also effectively achieves a high torsional stability or torsional strength in terms of the effects of torque about its longitudinal axis. High lateral strength can also be achieved by means of the binding mechanism proposed by the invention. As a result, the main feeling of the user is one of hold and stability, as a result of which the performance which can be achieved with the binding mechanism is enhanced still further. Another advantage is the fact that, due to the way in which the sports shoe is retained or accommodated, both in the front or toe-end terminal portion and in the rear or heel-end terminal portion, the sports shoe is accommodated or retained in the binding mechanism reliably and at the same time without wobbling, and the resultant stress or total stress is distributed on several retaining or coupling elements.

Also of advantage is the fact that the link chain has at least 3 to approximately 20 link parts, resulting in a high flexibility of the connecting element between the front and the rear retaining element, and a connecting element of this type can be adapted relatively exactly to the curvature or bending of the sole of a co-operating sports shoe when used for walking, climbing or telemark movements.

The advantage of the embodiment in which the link chain comprises approximately 8 to 12 link parts is that the link chain is relatively robust, but nevertheless has a pronounced ability to conform or adapt to the bending and deformation movements of the shoe sole.

As a result of the features whereby the link parts of the link chain are of a plate-type design and are dimensionally stable when exposed to the forces which can occur during use of the binding mechanism, an efficient force coupling is obtained between the user's foot and the board-type gliding device. In particular, any loss of force which would otherwise occur due to deformations or deviating movements of the binding mechanism are at least largely avoided. At the same time, the sports shoe is retained more firmly and reliably in the binding mechanism.

As a result of the features whereby the individual link parts and articulated connections of the link chain are designed so as to be torsionally strong or torsionally stable when subjected to the forces which occur during use of the binding mechanism, an efficient transmission of force can be guaranteed from the rear retaining element to the front retaining element directly connected to the sports device or gliding device. In particular, the forces introduced via the user's shinbone into the rear retaining element can be transmitted to the front retaining element and then into the board-type gliding device. This results in efficient control and a deflection of the board-type gliding device in a relatively rapid response, which is of particular importance during telemark skiing sports. These advantages can be achieved quite easily on the basis of relatively inexpensive precautions from a structural point of view.

In one embodiment, at last some link parts of the link chain are of differing lengths, the advantage of which is that the link chain is able to compensate for the different deformation or curvature zones of the sports shoe effectively. In particular, in the portion where a more pronounced curvature or bending is necessary or expedient, more articulation axes can be provided than in the part-portion in which only a relatively slight curvature or bending is necessary. This enables a good correlation to be achieved between ability to articulate and strength or ability to transmit force.

As a result of the advantageous features whereby the link parts in a portion disposed immediately adjacent to the front retaining element are shorter in dimension than the link parts in a portion of the link chain lying immediately adjacent to the rear retaining element, the connecting element or the link chain is able to bend in a more pronounced manner in the end portion lying immediately adjacent to the toes than in the end portion lying immediately adjacent to the heel. This results in an optimal correlation between flexibility or ability to articulate, torsional stiffness, manufacturing costs, component complexity and such like.

Another embodiment which offers an advantage is one in which at least one articulated connection between link parts of the link chain can released or removed if necessary and then re-connected, because the binding mechanism can be adapted particularly easily and rapidly to different shoe sizes and any modification or adaptation work can be undertaken rapidly and effortlessly.

In one embodiment, the articulated connection which can be released if necessary can be separated as two link parts are moved into a first relative position or angular position and the link parts are articulatingly and non-releasably connected to one another on assuming other relative positions or angular positions, as a result of which the connecting element can be moved aside without having to apply strong dismantling forces for this purpose. In addition, the articulated link between the articulated connections in regular use or deployment positions are reliably secured to prevent the connections from unintentionally coming apart.

As a result of the features whereby a length of the link parts corresponds to the smallest pitch unit or the smallest jump in size of a standard or standardised shoe size system, a specific number of link parts can be added or removed in order to adapt the binding mechanism simply and exactly to the desired or requisite shoe size.

As a result of the features whereby a length of the link parts corresponds to a fraction, for example a half or a third, of the smallest unit of a standard or standardised shoe size system, the respective sole length can be optimally adapted even if the shoe size or its shoe sole does not conform to a shoe size standard or no longer does so due to the occurrence of wear.

An ultimate breaking strength and small number of parts are needed to produce the binding mechanism due to the fact that a length of the link parts is a multiple of the smallest pitch unit of a shoe size system.

Due to the flexibility or the ability of the connecting element to bend, enabling the connecting element or the link chain to be moved from a largely longitudinally extending non-operating position into a convexly curved shape relative to a straight line connecting the front and rear retaining element with an arcuate, outwardly curved curvature, movement is transmitted harmoniously starting from an at least largely longitudinally extending non-operating position into an arcuately curved active position and vice versa, thereby enabling a movement to be effected that is as homogeneous or uniform and as natural as possible.

Due to features whereby at least individual link parts have at least one stop surface for limiting or fixing as small a pivoting angle as possible between mutually adjacent link parts, the degree of curvature can be limited and/or the possible curvature contour of the connecting element defined or predetermined. This provides a simple means of reliably avoiding detrimental overload or detrimental movements beyond a specific point or position. Furthermore, this enables a deformation or curvature contour of the link chain to be obtained which is made up of narrow arcs, flat arcs and/or straight portions. Consequently, more pronounced curvatures can be achieved in the front end portion of the link chain than in the rear end portion of the link chain, for example, so that the link chain is able to overcome the sole deformations which usually occur, at least for the most part.

The fact that the connecting element or the link chain is of an articulated design in the front part-portion or in the front half of the connecting element and the remaining part-portion or rear half of the connecting element is not articulated, means that a high degree of flexibility can be obtained in the front portion of the connecting element facing the toes, whereas the adjoining portion of the connecting element remains at least substantially rigid or plate-like, thereby reducing the number of links to an expedient minimum.

The fact that the rear retaining element is designed so that it its position can be varied and fixed relative to the front retaining element offers another option for adapting the binding mechanism to different shoe sizes, for example for obtaining a more refined setting of the binding mechanism.

The front end-portion of the sports shoe can be fixed or retained whilst optimising weight, due to the fact that the front retaining element has a retaining clamp for accommodating or fixing the front portion of a sports shoe.

The features defined in claim 18 ensure that the front end-portion of the shoe sole is firmly mounted and retained. In addition, the front retaining element is guaranteed to be capable of withstanding loads which occur when the user is using the board-type sports device to effect walking, running and alpine travel movements.

In another embodiment, the front retaining element is provided with at least one additional articulated link with a plate-type mounting element to provide a fixture to a top face of a board-type gliding device, permitting a pivoting connection, the advantage of which is that, as well as the connecting element being able to pivot or move, an extra articulated system is provided which has a different characteristic or different property in terms of movement compared with that which the connecting element effects between the front and the rear retaining element. In particular, the front retaining element is also mounted so that it can pivot relative to the top face of a board-type gliding device as a result. This combination of several rotation axes, which are of an essentially virtual or at least partially imaginary nature, enables rotating movements to be effected which are as close as possible to the natural motion sequence.

In one particularly advantageous embodiment of this additional articulated arrangement, between the front retaining element and the board-type gliding device, the front retaining element is coupled with the mounting element by means of at least two, preferably four, transmission arms, and the transmission arms are articulatingly connected to the retaining element on the one hand and to the mounting element on the other hand. In particular, this provides a composite or virtual pivot axis for the front retaining element.

As a result of other features whereby the transmission arms are oriented so that they cross one another by reference to a vertical plane oriented in the binding longitudinal direction, stable support is provided for the front retaining element with respect to the board-type gliding device, whilst nevertheless allowing the front retaining element to pivot relative to the board-type gliding device.

Due to the fact that the mutually crossing transmission arms are of differing lengths, the retaining element is shifted in the direction of the binding longitudinal axis when making step-like movements. This special kinematic design enables longer steps to be taken, which contributes to the performance which can be achieved.

Another advantage is the fact that a locking mechanism is provided, which can be activated if necessary in order to suppress the pivoting movement of the other articulated link because it means that the articulating or pivoting movement of the other articulated link can be suppressed as and when necessary. Furthermore, the binding mechanism can be adapted in a particularly simple manner to cater for a variety of conditions as well as individual requirements.

A strong, yet inexpensive locking mechanism can be achieved due to the fact that the locking mechanism has a pivotably mounted locking clamp, which prevents the pivoting movement between the front retaining part and the mounting element or blocks the other articulated link when in its active position. In addition, a locking mechanism of this type can be operated relatively intuitively by a user. This locking mechanism can also be operated under difficult ambient conditions or when wearing gloves without any difficulty.

A spring and restoring means co-operates with the connecting element or link chain, as a result of which the connecting element or the link chain is always pushed into an at least approximately longitudinally extended initial or non-operating position, thereby guaranteeing that the binding mechanism is in a defined initial position, even if no shoe is inserted in the binding mechanism. Furthermore, this enables a deformation resistance to be imparted to the link chain which is either barely perceptible to the user or if necessary a deformation resistance can be imparted which is perceptible to the user.

Due to the features whereby the spring and restoring means is provided in the form of at least one flexible bar or at least one leaf spring disposed in the core or centre region of the link chain, the spring and restoring means is integrated in the link chain, so to speak, and thus protected from excessive stress or pressure or compression stress. Furthermore, because the spring element is disposed close to the neutral zone or fibre of the link chain, the occurrence of any relative shifting between the spring and restoring means and the link chain is reduced to a minimum as the link chain deforms.

In another embodiment, the spring and restoring means extends at least across the entire length of the link chain, thereby resulting in an integral spring and restoring means which acts in a resiliently elastic manner across the full length of the link chain.

The fact that at least one spring and restoring means forces the front retaining element and the rear retaining element towards one another to a minimum distance from one another restricted by a stop ensures that the binding mechanism always assumes a defined initial position. As an alternative to or in combination with this, a sort of pushing and biasing effect can be obtained by a spring and restoring means acting accordingly, which ensures that a biasing force can be applied to the sports shoe via the front and rear retaining elements.

As a result of the features whereby a setting mechanism is provided for adjusting the spring force or rebound force of the spring and restoring means as and when necessary, the binding mechanism can be optimally adapted to individual requirements and to the prevailing conditions of use in terms or its spring force or its deformation resistance to pivoting movements.

In one embodiment, the articulated link between two link parts has at least one pin on the first link part, which engages in at least one co-operating recess of a second link part aligned with it, resulting in a link chain structure with robust articulated links, which also enables defined pivot axes with an exclusively rotating degree of freedom to be provided.

In other embodiments, the at least one pin of the first link part engages in at least one slot of the other link part oriented in the longitudinal direction of the link chain, which makes it easy to vary the length of or extend the link chain, thereby enabling variations in length to be compensated, for example during deformation movements or walking movements.

Due to the fact that the link parts making up a link chain have at least one orifice extending in the longitudinal direction of the link chain for accommodating an elongate flexible bar or spring and restoring means, the cohesiveness of the link chain and the individual link parts can be increased, whilst simultaneously providing an ideal adaptation of the flexibility of the co-operating binding element to the respective requirements.

As a result of the features whereby the connecting element or link chain are designed to be variable in terms of total length against the spring force of a spring and restoring means and the connecting element or link chain is designed to extend and elastically rebound against the spring force of the spring and restoring means, the link chain is able to extend or stretch elastically to enable changes in length to be compensated, due, for example, to changes in distance as a result of geometric arc or chord properties, especially in the case of different curvatures of the shoe sole relative to the connecting element. In addition, this also guarantees that the sports shoe is retained or fixed in an at least almost constant manner, in spite of the link chain assuming different positions or curvatures compared with the sole shoe of the sports shoe.

In one embodiment, the front retaining element is of a pedestal-type design and has at least one connection point for a first link of the link chain, the advantage of which is that a solid or strong retaining element is obtained which enables the binding mechanism to be reliably secured relative to the board-type gliding device and which also enables forces acting via the rear retaining element to be reliably absorbed. Where it is possible to provide several connecting or connection points, this will also provide an easy way of adapting to shoe size.

Due to the fact that the rear retaining element has at least one connecting point for connecting at least one end link of the link chain, the connecting element or link chain can merge into the rear retaining element responsible for holding and connecting the heel portion of the sports shoe in a structurally strong arrangement. Where it is possible to provide several connecting or connection points in this transition region, this also offers a simple means of adapting to shoe size.

As a result of the features whereby the link chain has a torsional strength on the one hand and a deformation resistance on the other hand with respect to lateral deviating movements and acts like a plate connection or rigid connection between the front and rear retaining elements, the user will experience a stable and safe feeling and the coupling between the foot of the user and the board-type gliding device can be designed so that it is as efficient as possible, free of loss and vibration. In particular, as a result, the motion sequences needed during telemark skiing can be effected unimpaired and an exact control or rapid-response steering of the board-type gliding device is guaranteed.

In one embodiment, at least one articulated link of the link chain permits a rotating and translating movement between two adjacent link parts, the advantage of which is that during curving movements of the connecting element, a longitudinal compensation can also be simultaneously achieved with respect to the sole of the sports shoes.

Due to the fact that the link parts are connected to one another by articulated links with an exclusively rotating or pivoting degree of freedom, a curvature or bending of the sports shoe or the sole is permitted unhindered during lifting movements of the heel, whereas all other movements of the sports shoe relative to the sports device are at least largely prevented, thereby resulting in ideal conditions for an efficient continuing movement or precise steering of the board-type gliding device.

Due to the features whereby at least two link chains are provided extending parallel with one another, the robustness of the connecting element and/or its torsional strength can advantageously be increased.

The fact that the link chains are disposed at a distance from one another and are connected to one another in at least certain portions by means of transversely extending webs specifically enables the torsional strength of the crawler-type connecting element to be significantly increased. An increase in the width of the connecting element therefore means that the thickness or width of the link chain can advantageously be reduced.

In one embodiment, at least one articulated link is provided between the link parts in the form of a hinge, and meshing projections on mutually facing ends of two link parts spaced at a distance apart from one another in the direction of the link axis engage in one another in a meshing arrangement, which makes for particularly robust articulated links capable of withstanding very high loads, which are also able to withstand pulse-type loads without any difficulty, such as occur during falls, for example.

The fact that a width of the link chain or the plate-type link parts is at least 15 mm to 60 mm, preferably approximately 30 mmt imparts a high torsional strength to the link chain, without its longitudinal side edges projecting beyond the side faces of a standard or conventional board-type gliding device.

Finally, in one embodiment, the biasing force of the rear retaining element can be adjusted by a spring means and is forced towards the front retaining part by a minimum distance restricted by a stop, the advantage of which is that a pushing and biasing effect is achieved which ensures that the sports shoe is secured in the binding mechanism reliably and without wobbling.

BRIEF DESCRIPTION OF THE DRAWINGS

The invention will be explained in more detail below with reference to examples of embodiments illustrated in the appended drawings.

DETAILED DESCRIPTION OF PREFERRED EMBODIMENTS

Figure 1:
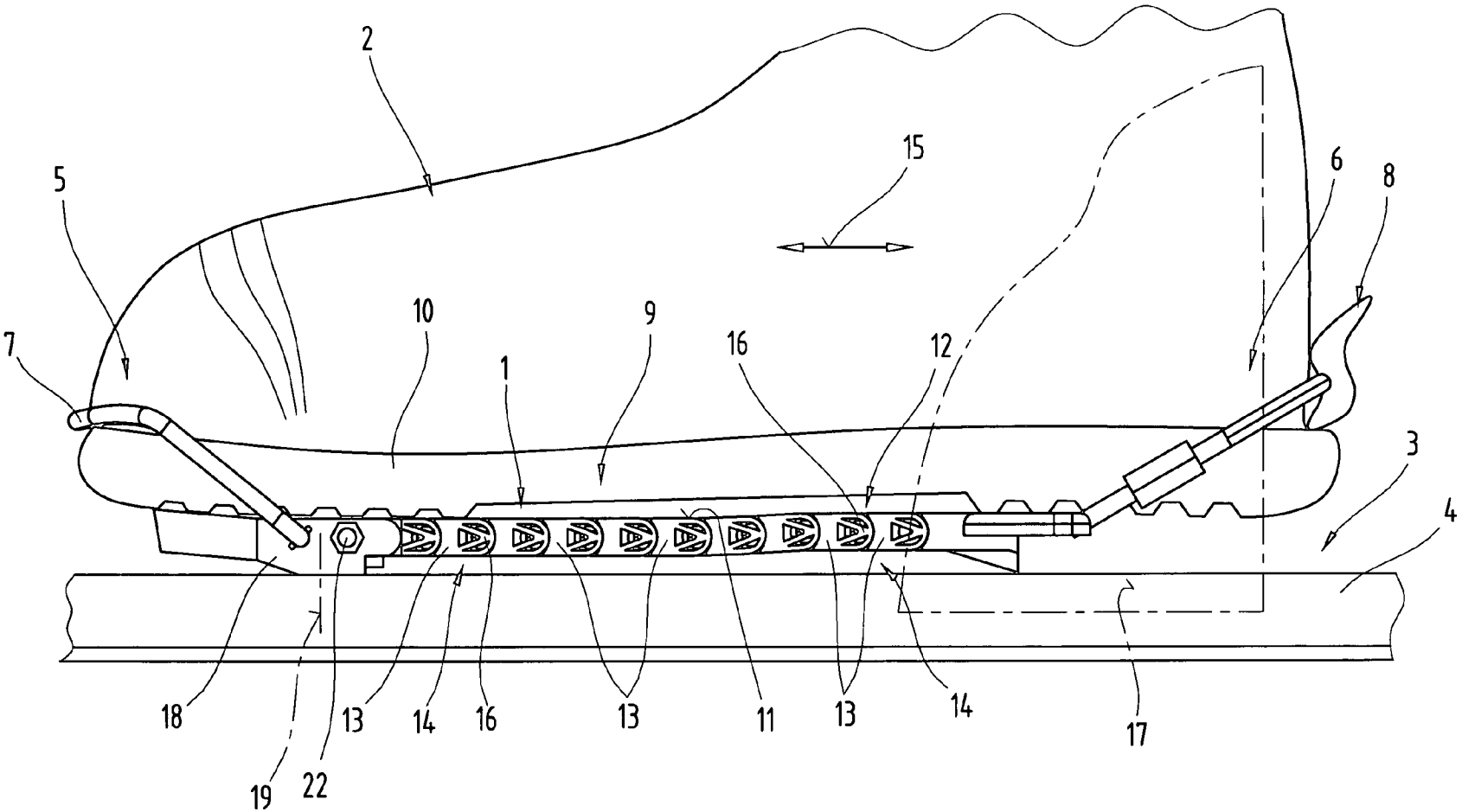
FIG. 1 shows a binding mechanism for a sports shoe in combination with a board-type gliding device with the sports shoe in the initial or non-operating position.

Firstly, it should be pointed out that the same parts described in the different embodiments are denoted by the same reference numbers and the same component names and the disclosures made throughout the description can be transposed in terms of meaning to same parts bearing the same reference numbers or same component names. Furthermore, the positions chosen for the purposes of the description, such as top, bottom, side, etc., relate to the drawing specifically being described and can be transposed in terms of meaning to a new position when another position is being described. Individual features or combinations of features from the different embodiments illustrated and described may be construed as independent inventive solutions or solutions proposed by the invention in their own right.

Figure 2:
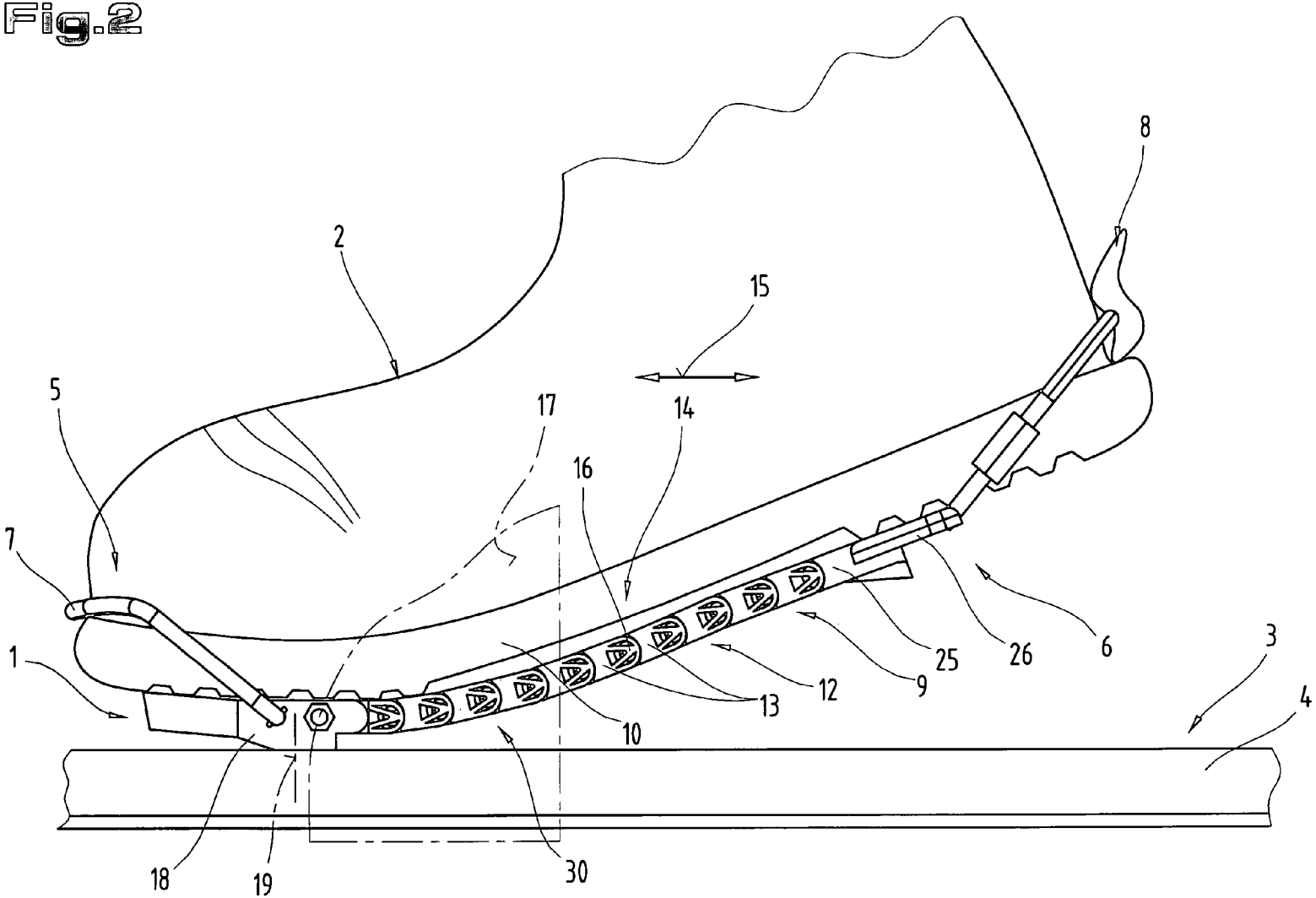
FIG. 2 shows the binding mechanism illustrated in FIG. 1 and the sports shoe connected to it in a situation where the heel portion is raised relative to the gliding device.
Figure 3:
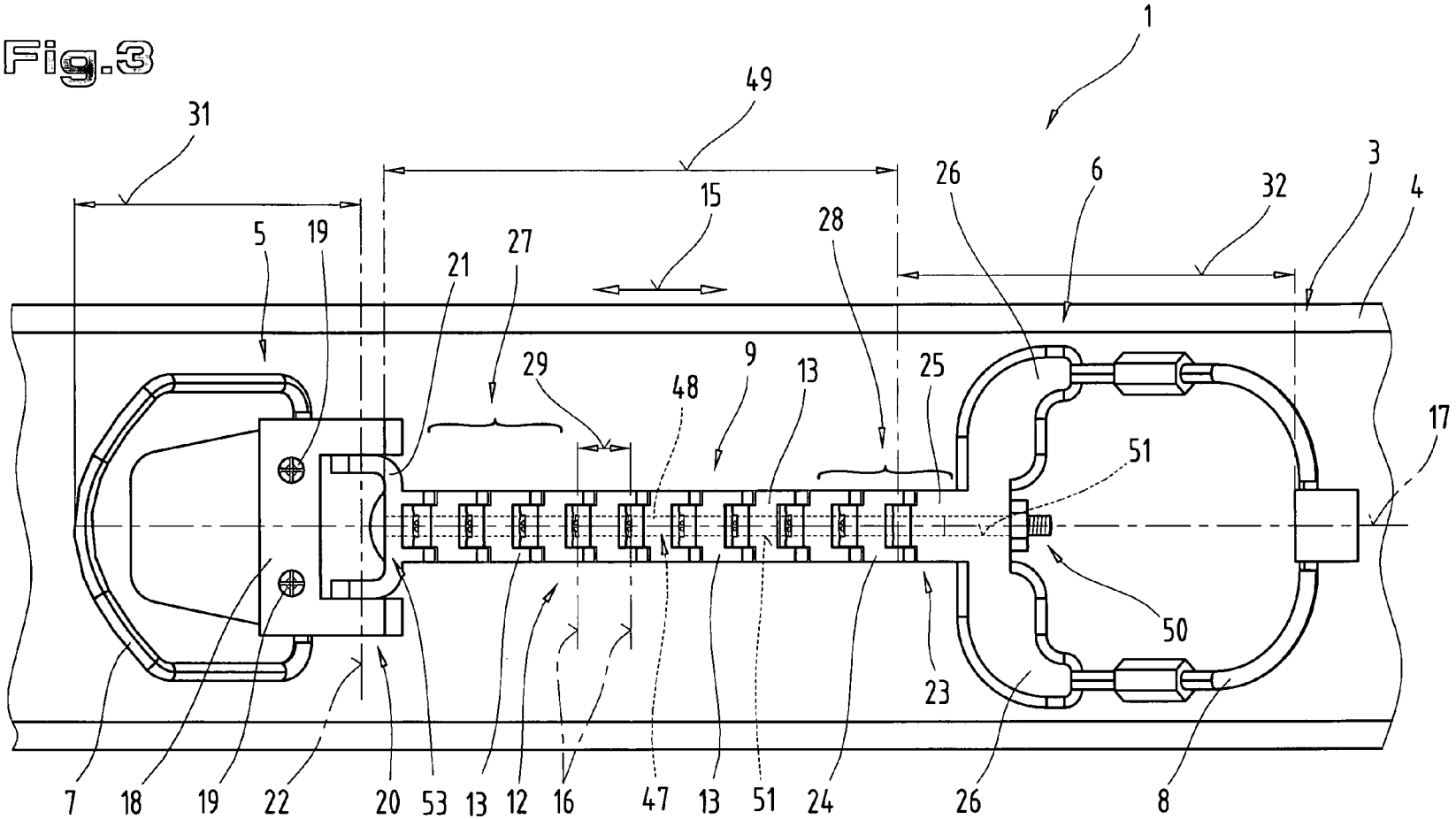
FIG. 3 is a simplified, schematic diagram showing the binding mechanism illustrated in FIG. 1 without a sports shoe, in a plan view onto the board-type gliding device.

FIGS. 1 to 3 illustrate one type of embodiment for the binding mechanism 1 intended to provide a pivotably displaceable connection between a sports shoes 2 and a board-type gliding device 3. The binding mechanism 1 described below is particularly suitable for telemark ski sports. However, this binding mechanism 1 may also be used as a long-distance alpine/cross-country binding or for practising country skiing sports away from prepared pistes due to the similar motion sequences involved. In another embodiment, it is also possible to re-set or adjust the binding mechanism 1 to suppress the resultant pivoting movement relative to a board-type gliding device 3 if necessary, so that the sports device can be used for travelling down mountain slopes or for use on pistes. Such locking mechanisms to prevent the binding mechanism from pivoting are known from the prior art and are available in a variety of designs.

Suitable sports shoes 2 which can be fitted in the binding mechanism 1 and released from it again when necessary are so-called telemark shoes or touring ski shoes or alternatively long-distance shoes. In principle, the sports shoes 2 might also be so-called outdoor or mountain shoes, in which case they may be fitted in the binding mechanism 1 to enable a user to use a board-type gliding device 3 by means of the binding mechanism 1.

The board-type gliding devices 3 are primarily skis 4. Preferably, skis 4 of the type used in pairs are used and the binding mechanism 1 is also used in pairs. Suitable skis 4 are primarily alpine skis, touring skis, telemark skis, long-distance skis and such like. The binding mechanism 1 can also be used on so-called split-boards, in the form of a mono-ski which can be split into two separate individual skis and vice versa.

The binding mechanism 1 comprises a first or front retaining element 5, which is designed to retain and accommodate the front toe-end portion of a sports shoe 2. The binding mechanism 1 also has at least a second or rear retaining element 6, designed to retain or accommodate the rear heel-end portion of a sports shoe 2 to be coupled with the binding mechanism 1. In the embodiment illustrated as an example, the two retaining elements 5, 6 are provided in the form of a retaining clamp 7 and a so-called clamp fastener 8, which is preferably disposed at the heel-end portion of the sports shoe 2. Alternatively, the two retaining elements 5, 6 may also be provided in the form of step-in binding elements, largely obviating the need for manual manipulations when stepping into the binding mechanism 1. Depending on the circumstances, the front or first retaining element 5 and/or the rear or second retaining element 6 may also be provided in the form of a so-called safety binding. These jaw bodies or retaining elements 5, 6 are designed so that the sports shoe 2 is released from the gliding device 3 or from the binding mechanism 1 in the event of critical or health-endangering loads or forces. In particular, if forces occur which exceed a pre-settable boundary or threshold value (for example the so-called Z-value), the sports shoe 2 or the user is automatically released from the gliding device 3 and binding mechanism 1.

The binding mechanism 1 also has an elongate or longitudinally extending connecting element 9 between the first and the second retaining element 5, 6.In particular, the connecting element 9 mechanically connects the front or toe-end retaining element 5 to the rear or heel-end retaining element 6. The connecting element 9, which will be described in detail below, therefore extends underneath a sole 10 of a sports shoe 2 inserted in the binding mechanism 1. Accordingly, the sole 10 of the sports shoe 2 may specifically be supported on at least certain regions of the connecting element 9. The connecting element 9 extends at least within the middle or central portion of the sole 10. When the binding mechanism 1 or connecting element 9 are in the initial or non-operating position illustrated in FIG. 1, an air gap may be formed in at least certain portions between the bottom face of the sole 10 and a top face 11 of the connecting element 9.

The essential factor is that the connecting element 9 is provided in the form of a link chain 12 with a plurality of connected link parts 13. The link chain 12 is made up of at least two link parts 13. Preferably, three to approximately 20 plate-type link parts 13 are connected to one another in an articulated arrangement. It has proved to be expedient or of advantage to provide a connecting element 9 in the form of a link chain 12 with approximately 8 to 12 plate-type link parts 13.

The individual link parts 13 of the link chain 12 are articulatingly connected to one another by means of a plurality of separate link joints 14. The individual link parts 13 therefore constitute a type of chain link of the connecting element 9 provided in the form of a link chain 12. The link joints 14 between the individual link parts 13 are disposed in series or one after the other by reference to the binding longitudinal axis—indicated by arrow 15. In other words, the individual link parts 13 are also disposed in a row in the direction of the binding longitudinal axis—arrow 15.

The articulation axes 16 of the individual link joints 14 are therefore oriented essentially horizontally and extend transversely to the longitudinal extension of the connecting element 9 and transversely to the binding longitudinal axis indicated by arrow 15.

The connecting element 9 between the toe-end retaining element 5 and the heel-end retaining element 6 is therefore provided in the form of a chain or crawler chain extending underneath the sports shoe 2 or underneath its sole 10. Depending on the circumstances, the link chain 12 may also be disposed in a recess of the sole 10. Recesses of this type in the sole 10 are primarily used with long-distance shoes. These recesses extending in the longitudinal direction of the sports shoe 2 serve as a lateral guide between the sole 10 and the connecting element 9 and enable the structural height of the sports article system comprising the gliding device 3, binding mechanism 1 and sports shoe 2 to be reduced.

The link chain 12 described above with the articulatingly connected link parts 13 extends within a vertical plane 17 extending in the binding longitudinal direction 15 and oriented essentially perpendicular to the top face 11 of the link chain 12 and of the board-type gliding device 1, and is able to move and change shape. In particular, the link chain 12 can be moved starting from the largely longitudinally extending initial or non-operating position within this vertical plane 17 illustrated in FIG. 1 into an arcuately curved position when the user is making walking or stepping movements so that the heel is lifted higher than the ball of the foot, as illustrated in FIG. 2, for example.

Within this vertical plane 17, therefore, the link chain 12 or the connecting element 9 is able to move or change shape via the individual link joints 14. In directions extending perpendicular to the vertical plane 17 and within a horizontally oriented plane, on the other hand, the connecting element 9 or link chain 12 is at least largely rigid or immobile when subjected to the forces or loads which usually occur when the binding mechanism 1 is being used for its intended purpose. Consequently, a walking or rolling sequence via the heel can be effected with this binding mechanism 1 that is as natural as possible. The link chain 12 likewise affords laterally guided stability or support to p0revent undesired lateral deviations between the gliding device 3 and the sports shoe 2. This connecting element 12 is also provided in the form of a relatively torsionally stiff link chain 12 and this connecting element 9 has extra torsional strength so that force can be transmitted as efficiently as possible without loss or delay between the sports shoe 2 and the gliding device 3 and versa. These effects are primarily achieved if at least some link parts 13 are of a plate-type design and the link parts 13 of the link chain 12 are designed to be dimensionally stable as far as possible when subjected to forces occurring and acting during use of the binding mechanism 1. Force can also be transmitted efficiently between the sports shoe 2 and the gliding device 3 due to the fact that the individual link parts 13 and link joints 14 of the link chain 12 are designed to be as torsionally strong as possible and torsionally stable when subjected to the forces which occur when the binding mechanism 1 is in use. Depending on the strength of the components used and depending on the forces which occur, minimal deviations of a few millimeters or a few angular degrees will occur at the binding mechanism 1.

In an embodiment of the type illustrated in FIGS. 1 to 3, the front retaining element 5 is rigidly or fixedly connected to the top face of a ski 4. In particular, a support element 18 of the first or front retaining element 5 supporting or retaining the front or toe-end portion of the sports shoe 2 is fixedly connected to the gliding device 3 or the ski 4. At least one screw 19 is used for this purpose, which extends through the front support element 18 and anchors it to the gliding device 3 or ski 4 firmly and largely without any ability to flex. In particular, the front retaining element 5 is of a pedestal-type design insofar as its support element 18 for the front end portion of the sports shoe 2 is provided in the form of a block-shaped body or in the form of a plate-type part, as may best be seen from FIG. 3.

The support element 18 or the retaining element 5 has at least one connection point 20 for the link chain 12. Depending on the circumstances, the front retaining element 5 or its support element 18 has a plurality of connection points 20 spaced apart from one another in the longitudinal direction 15 of the binding mechanism 1 in order to vary a binding length or a distance between the retaining elements 5, 6, enabling them to be individually set. The at least one connection point 20 of the front retaining element 5 in the embodiment illustrated as an example here is specifically designed for a first or initial link 21 of the link chain 12. In the embodiment illustrated as an example here, the initial link 21 is of a different design from the actual link parts 13 of the link chain 12 adjoining it. The initial link 21 is preferably connected to the first or front retaining element 5 so that it can pivot by means of a pivot axis 22. The pivot axis 22 extends essentially horizontally and transversely with respect to the binding longitudinal axis 15, in other words parallel with the articulation axes 16 between the individual link parts 13. The rear retaining element 6 may likewise have at least one connection point 23 to provide a connection for at least one end link 24 of the link chain 12. In the embodiment illustrated as an example here, the end link 24 of the link chain 12 is identical to the actual link parts 13 of the link chain 12. The at least one connection point 23 for the end link 24 of the link chain 12 is provided directly on a projection 25 of the rear, pedestal-type or plateau-like retaining element 6.

In the embodiment illustrated as an example, the front initial link 21 of the link chain 12 is of a more solid and stronger design than the adjoining first link part 13 of the link chain 12. The second or rear retaining element 6 has two shoulder-type support elements 26, which extend or project on either side of the central or middle projection 25 and are provided as a means of supporting the heel-end portion of the sole 10 of the sports shoe 2. These shoulder-shaped support elements 26 also provide a stable and tilt-free support for the rear retaining element 6 with respect to the top face of the board-type gliding device 3 as soon as the binding mechanism 1 assumes the non-operating position illustrated in FIG. 1 or a heel-end fixed, alpine take-off position. The lateral support elements 26 may also help to relieve the link chain 12 of load when the rear retaining element 6 is fixedly connected to the board-type gliding device 3 when necessary, for example for alpine skiing. Such heel locks are known from the prior art and are available in a variety of designs. A wire-shaped or tensioning clamp fastener 8 may advantageously be mounted on the lateral or wing-type support elements 26.

As may best be seen from FIG. 2, the connecting element 9 or the link chain 12 is articulated at least in the front part-portion or in the front part-half of the connecting element 9. The remaining part-portion or the rear part-half of the connecting element 9 can effectively be non-articulated or largely rigid. The essential factor is that the connecting element 9 or the link chain 12 co-operates at least with the part-portion between the toes or base of the toes and the adjoining ball of the foot, thereby enabling as rounded as possible or natural as possible a rolling motion via the balls of the feet. In particular, angular or non-rounded or so-called "Frankenstein-like" walking movements should be largely prevented via the link chain 12 between the front or first retaining element 5 and the rear or second retaining element 6. Accordingly, the connecting element 9 may also be formed by a structural combination of several link parts 13 with an adjoining stiff or non-articulated plate part. This plate part, which is relatively long or large compared with the link parts 13, expediently co-operates with the rear or heel-end end portion of the binding mechanism 1. In particular, the rear retaining element 6 may have a relatively elongate, plate-type projection 25, which merges more or less at the binding centre into a link chain 12 comprising a plurality of link parts 13.

If necessary, at least some link parts 13 of the link chain 12 are of different lengths. It is expedient if the link parts 13 in a portion 27 lying closest to the front retaining element 5 are of a relatively shorter design than the link parts 13 disposed in a portion 28 of the link chain 12 lying closest to the rear or second retaining element 6.

In one advantageous embodiment, an effective length 29 of the link parts 13 of the smallest pitch unit or the smallest jump in size is within a standard or standardised shoe size system. By shoe size system is meant shoe sizes based on the French, English or so-called Mondopoint shoe size system and other shoe size codes.

Alternatively, a length 29 of at least individual link parts 13 of the link chain 12 may be a fraction of the smallest unit or the smallest jump in size of a standard or standardised shoe size system. For example, the length 29 of individual link parts 13 of the link chain 12 may be one third or a half of a pitch unit of a shoe size system, for example the French shoe size system.

Optionally, a length 29 of the link parts 13 may also be a multiple of the smallest pitch unit of a shoe size system, in which case particularly robust or strong link chains 12 or connecting elements 9 can be provided. The dimensions described above or the effective lengths 29 of the link parts 13 enable the binding mechanism 1 to be optimally adapted to different shoe sizes. In particular, by adding or removing link parts 13 of an appropriate length 29, a binding mechanism 1 can be adapted exactly and rapidly to the different shoe sizes of various users. The essential factor is that the chain or crawler-type connecting element 9 of the binding mechanism 1 can be adjusted and re-set for walking or climbing movements or for downward knee movements during telemark skiing sports, starting from a largely longitudinally extending non-operating position (FIG. 1) into a convex curve oriented with an arcuate curvature 30 (FIG. 2) relative to the top face of a board-type gliding device 3. In particular, the link chain 12 can assume an outwardly convex or downwardly extending curvature 30 relative to an imaginary line linking the front and rear retaining elements 5, 6 when the binding mechanism 1 and the sports shoe 2 are in a raised active position relative to the board-type gliding device 3 as illustrated by way of example in FIG. 2. All other degrees of freedom are therefore at least largely prevented. In other words, the connecting element 9 is able to change its shape or adapt its shape exclusively within the vertical plane 17 extending in the binding longitudinal direction 15 due to the plurality of link joints 14 between the link parts 13. In particular, the crawler-type connecting element 9 is able to adapt to the curvature or flexing of the sole 10, whereas the link chain 12 remains relatively rigid in different or other directions, in particular in the direction perpendicular to the vertical plane 17. Of particular advantage is the fact that the described connecting element 9, in particular the link chain 12 with its definitive or clear link joints 14, is also able to withstand the torsional forces relatively well, which would otherwise cause the connecting element 9 to be overcome about the binding longitudinal axis 15. This is primarily achieved by using link joints 14 or articulation axes 16 with an exclusively rotating degree of freedom between link parts 13 aligned in a row. In particular, link joints 14 are fitted between two link parts 13, which respectively form clear and stable articulation axes 16 in terms of orientation, extending transversely or perpendicular to the vertical plane 17.

As may best be seen from FIG. 3, a longitudinal extension 31 of the front retaining element 5 is a multiple of the length 29 of a link part 13 of the link chain 12. This provides stable support for the toe region or front end portion of the sports shoe 2 on the binding mechanism 1 and with respect to the front retaining element 5. The longitudinal extension 31 of the front retaining element 5 is expediently a maximum of 12 cm, in particular approximately 5 to 10 cm. Within this longitudinal extension 31, the front plate-like or block-type retaining element 5 is of a largely rigid design. Adjoining this essentially intrinsically stiff retaining element 5 is the articulated link chain 12 which changes shape in a defined manner and serves as a connecting element 9 to the rear retaining element 6.

A longitudinal extension 32 of the rear retaining element 6 is usually a multiple of the length 29 of a link part 13. This results in a sufficiently clearance-free and stable retention of the sports shoe 2 in the binding mechanism 1 via the retaining elements 5, 6. The link chain 12 extending in between ensures sufficient movement but affords a deliberately stiff but torsionally stable connection between the rear, pivotable retaining element 6 and the front retaining element 5 fixed on the ski.

Figure 4:
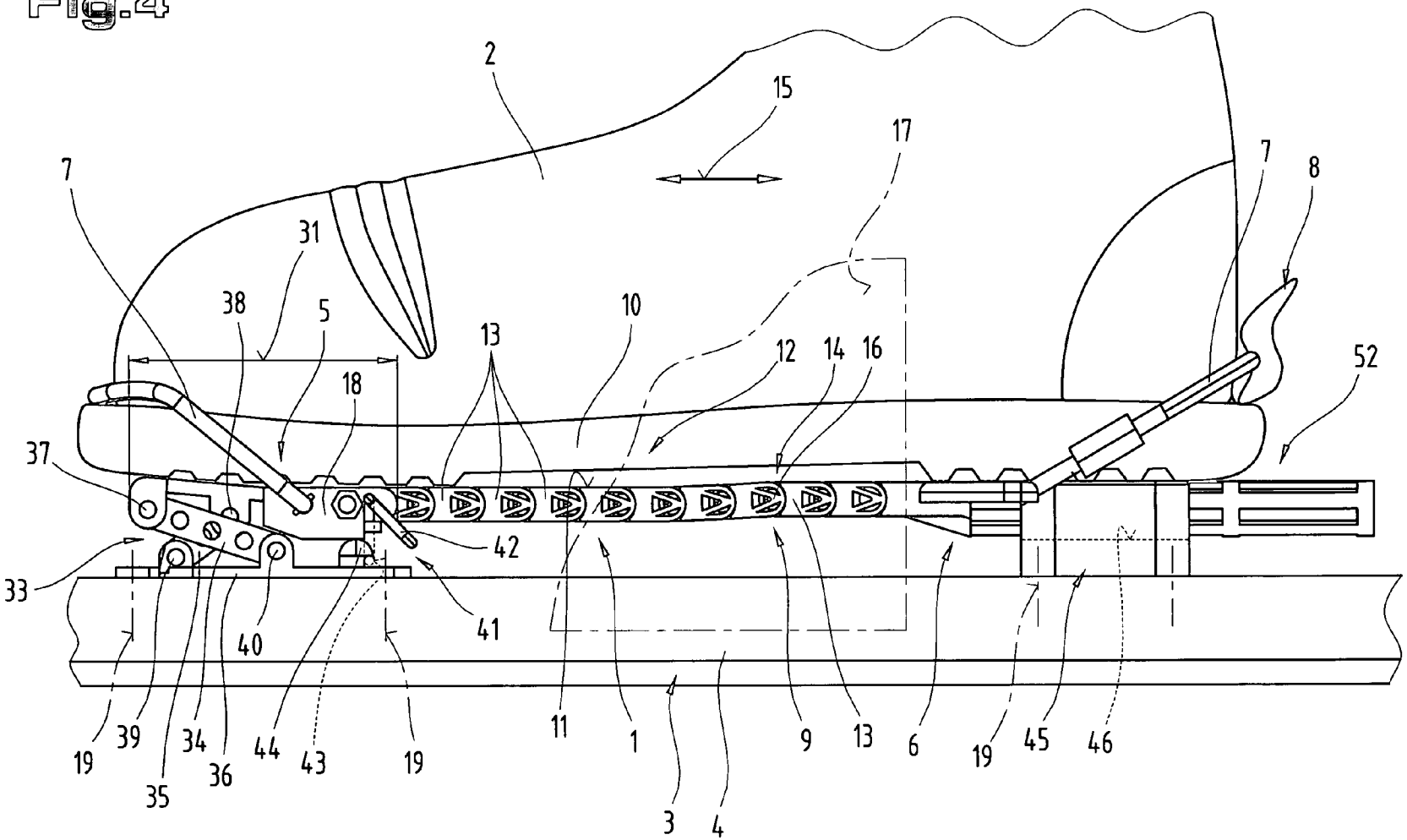
FIG. 4 shows another embodiment of the binding mechanism for a sports shoe in combination with an additional articulated link with respect to a board-type gliding device.
Figure 5:
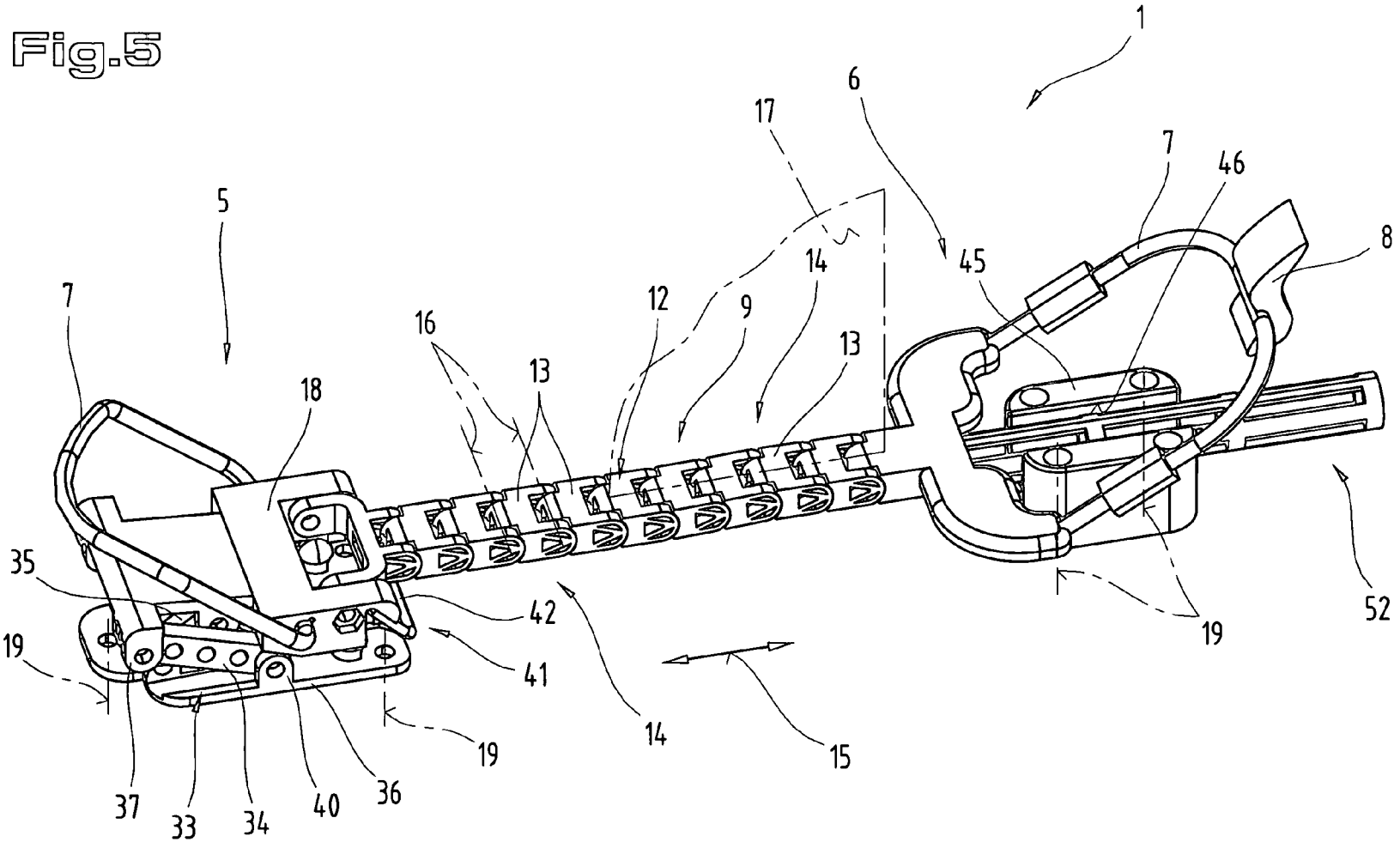
FIG. 5 is a perspective view of the binding mechanism illustrated in FIG. 4 from above, without a sports shoe.
Figure 6:
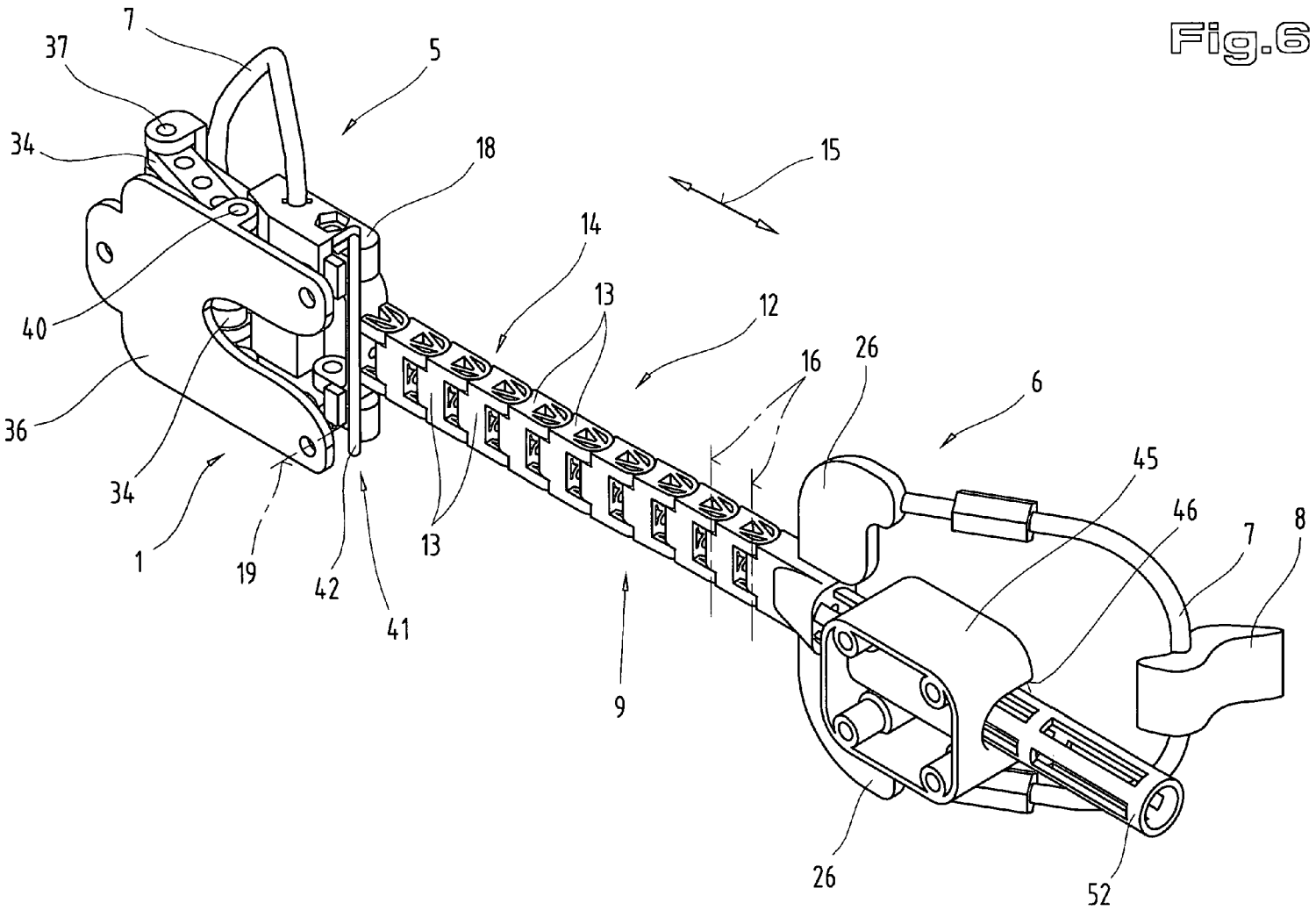
FIG. 6 is a perspective view of the binding mechanism illustrated in FIG. 4, seen from underneath.

FIGS. 4 to 6 illustrate another embodiment of the binding mechanism 1. The binding mechanism 1 again comprises a front retaining element 5 and a rear retaining element 6, which is connected to the front retaining element 5 via the articulated connecting element 9. In particular, the rear retaining element 6 is mechanically coupled with the front retaining element 5 by means of the connecting element 9, comprising a plurality of link parts 13. The rear connecting element 6 is likewise displaceable about an arcuately shaped path relative to the front retaining element 5. The arcuately shaped path which the rear retaining element 6 describes during lifting and lowering movements is primarily defined by the properties of the link chain 12 and by the properties or flexibility of the sports shoe 2 used in the binding mechanism 1.

In addition to the basic elements described above, the binding mechanism 1 illustrated in FIGS. 4 to 6 has an additional articulated link 33, by means of which the front retaining element 5 is pivotably and articulatingly connected to the board-type sports device. This articulated link 33 corresponds to an articulated connection of the type described in document EP 0 904 809 A1 filed by the same applicant. The full contents disclosed in EP 0 904 809 A1 are explicitly included herein by reference and form part of this document. As illustrated in the diagrams shown in FIGS. 4 to 6, the articulated connection has at least two, preferably four transmission arms 34, 35. In particular, the front retaining element 5 is pivotably connected via the articulated link 33 to a plate-type mounting element 36 which is secured to the top face of a board-type gliding device 3. In particular, the front retaining element 5 is coupled via at least two, preferably four transmission arms 34, 35, to the mounting element 36 on the ski-side or fixed to the ski. The transmission arms 34, 35 are articulatingly connected to the retaining element 5 on the one hand and to the mounting element 36 on the other. By reference to the vertical plane 17 oriented parallel with the binding longitudinal direction 15, the two transmission arms 34, 35 are disposed in a crisscross arrangement or cross with one another, as may best be seen from FIG. 4. In particular, the top ends of the two transmission arms 34, 35 are connected via links 37, 38 to the front retaining element 5, whereas the bottom or distal end portions of the transmission arms 34, 35 are articulatingly connected via other links 39, 40 to the mounting element 36. In other words, this articulated link 33 between the binding mechanism 1 and the board-type gliding device 3 comprises four links 37 to 40 with two mutually crossing transmission arms 34, 35. In order to increase the strength and in order to increase the torsional strength of the binding mechanism 1, two pairs of transmission arms 34, 35 are preferably provided. This parallel connection of transmission arms 34, 35 is preferably disposed transversely to the width of the board-type gliding device 3. In other words, the multiple arrangement of mutually crossing transmission arms 34, 35 is expedient as a means of increasing the strength of the binding mechanism 1. In one advantageous embodiment, the mutually crossing transmission arms 34, 35 are of differing lengths. This results in advantageous kinematics and permits optimised motion sequences between the sports shoe 2 or binding mechanism 1 and the sports device or gliding device 3. The transmission arm 34 which is articulatingly connected to the foremost point by reference to the binding longitudinal axis 15 via the link 37 to the front retaining element 5 is preferably longer than the transmission arm 35 connected to the retaining element 5 via the rear link 38.

In one advantageous embodiment, the binding mechanism 1 has a locking mechanism 41 which can be activated as and when necessary, by means of which the pivoting movement of the other articulated link 33 can be suppressed. In the diagram shown in FIG. 4, the inactive position or disposition of the locking mechanism 41 is shown by solid lines. The active position of the locking mechanism 41 in which the articulation or movement of the other articulated link 33 is suppressed, on the other hand, is indicated by broken lines. In particular, when the locking mechanism 41 is activated, the front retaining element 5 is secured to the top face of the board-type gliding device 3 so that it does not articulate or can not move. The locking mechanism 41 may be provided in the form of a pivotably mounted locking clamp 42, which prevents pivoting movements between the front retaining part 5 and the mounting element 36 when in its active position—shown by broken lines in the diagram—i.e. when the locking clamp 42 is in its active position 43 indicated by broken lines, relative movements of the links 37 to 40 of the articulated link 33 are locked or prevented. When the locking mechanism 41 is in the active position—shown by broken lines in FIG. 4—the pivotably mounted locking clamp 42 engages behind a catch lug 44 and thus prevents the retaining element 5 from being raised or pivoted upwards in its end portion lying closest to the link chain 12. In particular, the front retaining element 5 remains oriented more or less parallel with the top face of the gliding device 3 when the locking mechanism 41 is switched to the active position 43 by the user of the binding mechanism 1. When the locking mechanism 41 is in the locked position, the link chain 12 exclusively is able to articulate, thereby enabling a rolling movement of the sports shoe 2 with respect to the top face 11 of the board-type gliding device 3. In the situation where the other articulated link 33 is actively usable, the most harmonious or uniform or stepless possible rolling movement is achieved via the sole 10 of the sports shoe 2 both via this articulated link 33 and due to the flexibility or articulation of the link chain 12 when the user effects walking, climbing or downward knee movements.

The mounting element 36 by means of which the binding mechanism 1 can be mounted on the gliding device 3 is preferably likewise secured by means of at least one screw 19 to the top face of an appropriate board-type gliding device 3.

In the end portion lying closest to the rear or heel region, the binding mechanism 1 has a support body 45 for the heel-end sole-portion of the sports shoe 2 and for the rear retaining element 6. This support body 45 is preferably also secured to the top face of the gliding device 3 by means of at least one screw 19. The support body 45 has at least one groove-type recess 46 extending in the direction of the binding longitudinal axis 15, which serves as a lateral guide mechanism for the rear end portion of the binding mechanism 1 and for the rear retaining element 6. In particular, the support body 45 serves as a means of absorbing the forces acting vertically on the top face and for absorbing lateral forces oriented perpendicular to the vertical plane 17 in situations where the binding mechanism 1 is in the initial or non-operating position illustrated in FIG. 4 or FIG. 5. In this initial or non-operating position, the link chain 12 or the connecting element 9 extends essentially parallel with the top face of the gliding device 3.

To enable the binding mechanism 1 to be specifically designed as a touring binding, a so-called climbing aid known from the prior art, which can be activated and deactivated as necessary, is provided in the rear end portion, which enables support to be provided for the rear retaining element 6 in at least a raised position relative to the top face of the gliding device 3. This climbing aid may also be provided by adapting the support body 45 accordingly.

In order to design the binding mechanism 1 as an alpine binding or in order to design it additionally or alternatively as a fixed heel binding, a so-called heel fixing may be provided in the rear end portion or heel anchoring may be provided which can be activated and deactivated as and when necessary and which prevents the heel portion or the rear retaining element 6 from being raised relative to the board-type gliding device 3 when in the active position. This heel anchoring or this "heel lock" may also be provided by adapting the support body 45 accordingly.

A major advantage of the embodiment illustrated in FIGS. 4 to 6 resides in the fact that a relatively more natural pivoting motion sequence can be achieved for the front, intrinsically rigid, plate-like retaining element 5 by means of the additional articulated link 33. In addition, the chain-type connection of the front retaining element 5 to the rear retaining element 6 prevents hardly any bending or curvature of the sports shoe 2, so that a walking or stepping movement that is as natural as possible or relatively ideal from a physiological point of view can be effected by means of the binding mechanism 1 proposed by the invention in combination with a board-type gliding device 3.

As may best be seen from FIG. 3, in one design of the binding mechanism 1, at least one spring and restoring means 47 co-operates with the connecting element 9 or link chain 12. This spring and restoring means 47 thus continuously forces the connecting element 9 or link chain 12 into an at least approximately longitudinally extending initial or non-operating mode, as illustrated in FIGS. 1 and 3, for example. This at least one spring and restoring means 47 may be provided in the form of at least one elastically deformable and resiliently elastic flexible bar 48 or at least one leaf spring designed accordingly. The flexible bar 48 or the appropriately designed leaf spring may be made from spring steel, for example, or from any other metal having the appropriate properties or also from appropriate plastic materials. In one advantageous embodiment, this spring and restoring means 47 for the link chain 12 or for the connecting element 9 is disposed in the core or centre region of the link chain 12. In particular, this spring and restoring means 47 may be disposed at least partially in the interior of the link chain structure or this spring and restoring means 47 or may also be of a multiple design, in which case it acts on the individual link joints 14. In particular, at least one spring and restoring means 47 may be disposed respectively in the transition regions between the individual link parts 13, which forces the individual link parts 13 into an extended position assuming an approximately straight line.

At least one elongate or bar-shaped or rebounding means is preferably provided, which extends at least across a total length 49 of the link chain 12. The spring and restoring means 47 of the link chain 12 may be provided in the form of a sort of spiral spring or a coiled spring steel wire, for example. This being the case, this spring and restoring means 47 is resiliently elastic transversely to its longitudinal axis, on the one hand, so that it assumes a defined initial position in a substantially straight line. Furthermore, a resiliently elastic biasing action can be transmitted via a spring and restoring means 47 of this type to the link chain 12, which acts parallel with the longitudinal extension of the link chain 12. In particular, such a spiral spring-type spring and restoring means 47 is able to vary in length or rebound in a resiliently elastic manner and is resiliently elastically deformable, and is therefore particularly suitable for use in combination with the link chain 12.

In one advantageous embodiment, the spring and restoring means 47 may also be provided as a means of forcing the front retaining element 5 and the rear retaining element 6 towards one another to a minimum distance which is restricted by a stop. Especially if the mechanical link parts 13 of the link chain 12 permit a length variability or a length variation of the connecting elements 9 to a limited degree, the at least one spring and restoring means 47 may be provided or disposed as a means of forcing the two retaining elements 5, 6 into a position lying as close as possible to one another and mechanically restricted by means of a stop, as illustrated in the diagram shown in FIG. 3 by way of example. In particular, by means of an elastic biasing action between the front retaining element 5 and the rear retaining element 6 which continuously forces these elements to a distance from one another that is as short as possible, a sort of pushed biasing action is obtained which ensures that the sports shoe 2 is securely retained in the binding mechanism 1. At the same time, this enables the sports shoe 2 to be fixed in the binding mechanism 1 virtually without wobbling, because any tolerances or inaccuracies can be compensated by this biasing action or by the spring and restoring means 47 of the link chain 12.

Furthermore, this biasing action which forces the link chain 12 into a shortest possible length causes a compensation in length or variation in length. In particular, it enables variations in length between the front and the rear retaining element 5, 6 to be compensated by means of the spring-biased link chain 12 depending on the walking or rolling movement, at least to a certain degree, without blocking or excessive clamping on the sports shoe 2 or on its sole 10 when rolling or walking movements are effected using the binding mechanism 1.

As also schematically indicated in FIG. 3, a setting mechanism 50 may be provided for the spring and restoring means 47. This setting mechanism 50 is provided as a means of adjusting the spring force or the rebound force of the spring and restoring means 47 if necessary.

As may also be seen from the embodiment illustrated as an example in FIG. 3, the link chain 12 or the mutually aligned link parts 13 may have an orifice 51 extending in the longitudinal direction of the link chain 12 or a groove-shaped recess, which is designed as and serves as a means of accommodating the elongate spring and restoring means 47. In particular, the spring and restoring means 47 and the corresponding flexible bar 48 extend in this orifice 5 1, of which at least one is provided, across the entire length 49 of the link chain 12. Co-operating with an end face of this spring and restoring means 44, therefore, is a setting mechanism 50 for adjusting or individually varying the biasing or spring force if necessary. This setting mechanism 50 may be simply provided in the form of a thrust bearing for the spring and restoring means 47, the position of which can be varied. Accordingly, this thrust bearing may be provided in the form of a threaded nut, which can be adjusted with the aid of tools or preferably without tools.

The design described above enables the connecting element 9 or the link chain 12 to be variably restricted in its total length against the spring force or spring biasing action of the spring and restoring means 47 or designed so that its length can be varied against the spring force. In particular, the connecting element 9 or link chain 12 is designed to be elastically extendable and elastically rebounding against the spring force of the spring and restoring means 47.

In one embodiment of the binding mechanism 1, the rear retaining element 6 may be varied in position relative to the front retaining element 5 and fixed. In particular, a guide mechanism may be provided extending in the direction of the binding longitudinal axis 15, which permits a displacement of the rear retaining element 6 relative to the connecting element 9 or relative to the link chain 12. This enables an alternative or additional adaptation to be made to the distance between the front retaining element 5 and the rear retaining element 6 depending on the shoe size of the respective user. This guide mechanism between the rear retaining element 6 and the connecting element 9 may incorporate any known releasing and locking means known from the prior art as a means of fixing the rear retaining element 6 in the desired relative position corresponding or more or less corresponding to the respective shoe size.

FIGS. 4 to 6 illustrate another advantageous embodiment of the disposition of the spring and restoring means 47 or an additional spring element. In particular, this additional or multi-component spring and restoring means 47 is also disposed adjoining the link chain 12 or adjoining the retaining element 6. In the embodiment illustrated, a receiving or retaining element 52 is provided, which is provided as a means of retaining or mounting the actual or an additional spring and restoring means 47 for the link chain 12. In the embodiment illustrated as an example, this receiving or retaining element 52 is provided in the form of a hollow cylindrical or tubular projection on the rear retaining element 6. Inserted inside this tubular receiving or retaining element 52 is either an additional or the actual spring and restoring means 47, which acts in a resiliently elastic manner on the link chain 12, as may best be seen from the diagram shown in FIG. 7.

Figure 7:
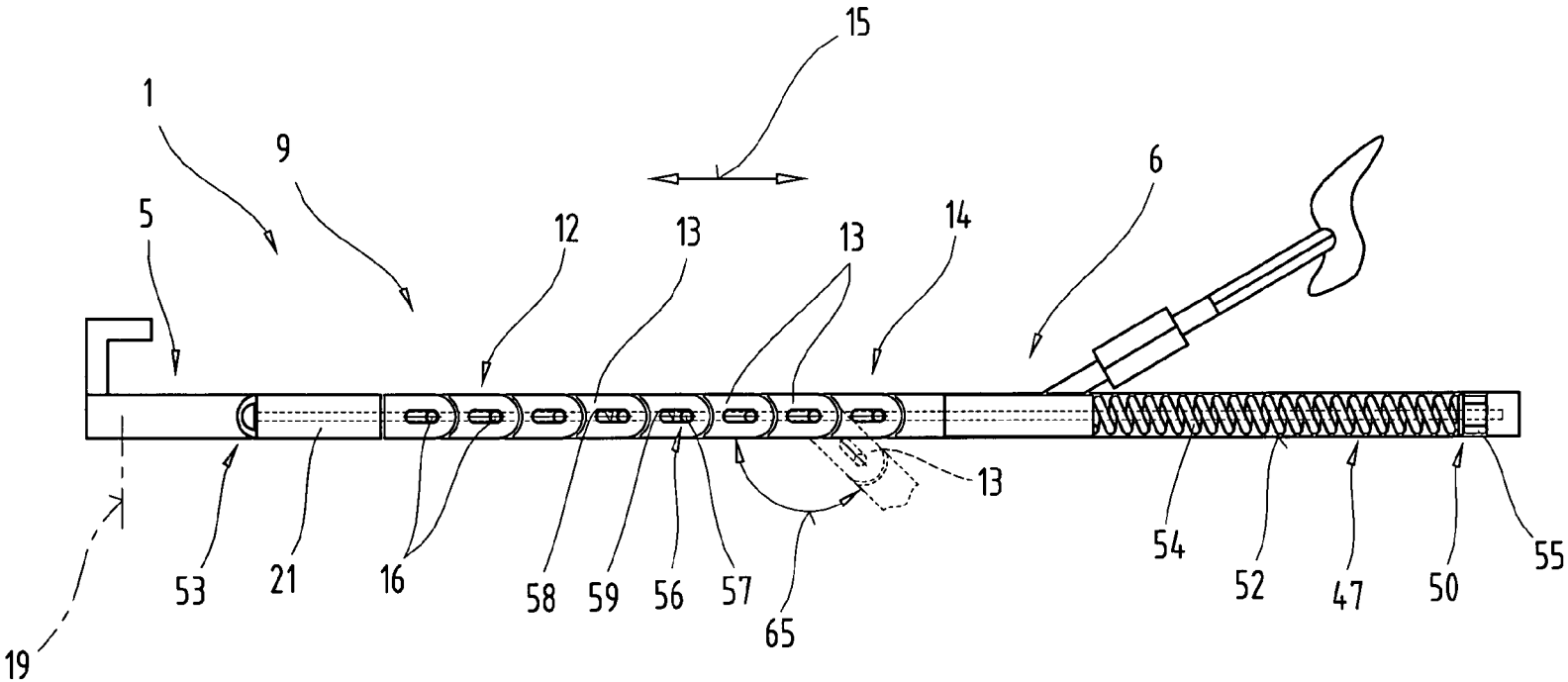
FIG. 7 shows another embodiment of the connecting element between the retaining parts of the binding mechanism in the form of a link chain.

As may be seen in particular from the embodiment illustrated in FIG. 7, a resilient or elastically flexible multi-part spring and restoring means 47 may be provided, which extends through the link chain 12. At a front or first end, the spring and restoring means 47 is supported by means of a thrust bearing 53. This thrust bearing 53 may be defined by the initial link 21 or by the front retaining element 5. In the second or rear end region of the link chain 12, an additional spring element 54 is provided, which is preferably mounted in the receiving or retaining element 52. Alternatively, it is also possible to dispense with such a receiving or retaining element 52 for the spring element 54. This spring element 54 is preferably provided in the form of a compression spring, in particular a spiral compression spring. The flexible bar-type spring and restoring means 47 therefore extends through this heel-end spring element 54. The setting mechanism 50 by means of which the biasing action of the spring element 54 and/or the spring and restoring means 47 may optionally be individually varied or set may be provided in the end portion of the spring element 54 remote from the link chain 12. In the embodiment illustrated as an example, this setting mechanism 50 is provided in the form of a so-called migrating nut arrangement 55. The flexible bar-type rebound and spring means 47 may therefore be of a design which does not extend or is tensionally rigid. The essential factor is that the flexible bar-type spring and restoring means 47 is designed to be flexible or bendable transversely to its longitudinal direction in order to enable or permit deformations of the link chain 12.

In one advantageous embodiment, the link chain 12 is elastically extendable or stretchable and rebounds elastically in the binding longitudinal direction 15. To this end, the link joints 14 are preferably of a special design. In particular, at last one articulated connection 14 has a longitudinal compensation 56 within the link chain 12. This telescopic longitudinal compensation 56 between at least two link parts 13 enables the link chain 12 to extend against the spring or biasing force of the spring and restoring means 47. The at least one longitudinal compensation 56 is preferably designed so that at least one of the link joints 14 has at least one pin 57 between two link parts 13, which engages in at least one corresponding cut-out 58 of an aligned or articulatingly connected link part 13. The cut-out 56, in which the pin 57 of a closest lying link part 13 engages, is preferably provided in the form of a slot 59 extending in the direction of the binding longitudinal axis 15. The pin 57 and a co-operating slot 59 between two link parts 13 then permit a combined translating and rotating movement of the articulated connection 14. In particular, the slot 59 and the pin 57 inserted in it form a telescopic or length adjustable connection between mutually adjacent link parts 13. In other words, the at least one articulated connection 14 of the link chain 12 permits a rotating and translating displacement between two mutually adjacent link parts 13. Alternatively, it would naturally also be possible for the link parts 13 to be connected via the link joints 14 with an exclusively rotating or pivoting degree of freedom.

It is therefore expedient if at least one pin 57 of a first link part 13 engages at least in one slot 59 of the other or an adjoining link part 13 oriented in the longitudinal direction of the link chain 12, as schematically indicated in FIG. 7. The structural features described above impart torsional rigidity or torsional strength to the link chain 12, which may be as effective with respect to lateral deviating movements as a plate connection or a known rigid connection between the front and rear retaining elements 5, 6.

Figure 8:
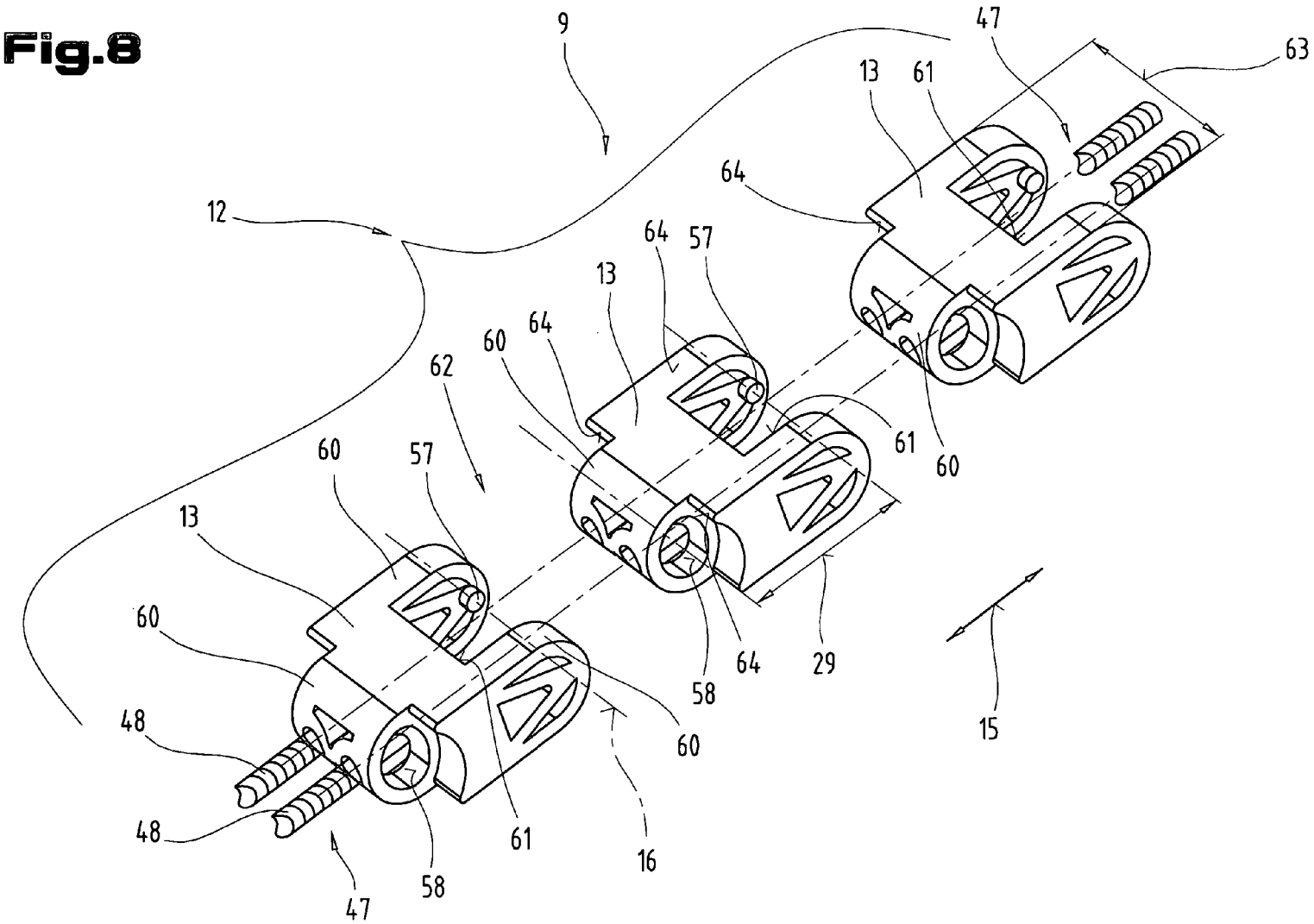
FIG. 8 shows an example of an embodiment for link parts used to make up the link chain for the binding mechanism.

FIG. 8 illustrates individual designs of link parts 13 as examples, which are used to form a cohesive link chain 12. The examples illustrate how a positive connection can be achieved between mutually adjacent link parts 13 to be coupled with one another. In particular, this also produces a positively acting articulated connection which is defined by an integrally formed pin 57 in an end portion of the link part 13, for example, and by means of cut-outs 58 matching these pins 57 in the oppositely lying end portion. The pins 57 may therefore positively engage in the cut-outs 58 and define the respective link joints. In the embodiment illustrated as an example, a cross-sectional dimension of the cut-outs 58 is a multiple of the cross-sectional dimension of the pins 57, thereby resulting in an articulated or rotating connection between adjacent link parts 13 and also enabling a linear displacement between the link parts 13. The link parts 13 are preferably of a plate-type design.

Disposed in a first end portion of the link part 13 is at least one projection 60. In the oppositely lying end portion of the link part 13 is at least one matching cut-out 61. Two link parts 13 disposed in a row with the same orientation can therefore engage in one another by means of the at least one projection 60 and the at least one matching cut-out 61. In particular, adjacent link parts 13 engage in one another in a meshing arrangement.

Meshing-type projections 60 are preferably disposed at a distance apart from one another in the direction of the joint axis 16, between which the cut-out 61 is defined. A matching projection 60 of an aligned link part 13 to be linked can engage in this cut-out 61. Mutually adjacent link parts 13 can therefore be articulatingly connected to one another in the form of a hinge 62. This imparts high stability and strength to the link chain 12. In particular, the link chain 12 has high tensile strength, torsional strength and breaking strength with respect to the individual link joints 14 as a result.

A high breaking strength and an ability to withstand high stress can also be imparted to the link chain 12 if a width 63 of the link part 13 or the link chain 12 is at least 15 mm to 60 mm. It is expedient or of advantage if this width 63 of the link chain is approximately 30 mm because the link chain 12 can then be positioned underneath soles without the link chain 12 projecting out from the side of the board-type gliding device, in particular from the ski or longitudinally extending ski.

In one advantageous embodiment, at least individual link parts 13 have stop surfaces 64 for restricting a pivot angle, in particular a minimum possible pivot angle between mutually adjacent link parts 13. This prevents the link chain 12 from being moved into impractical or problematic positions or angles of inclination. Due to the curvature of the link chain 12 defined by the restricting stop surfaces 64, the rear retaining element 6 can also be prevented from moving so that it lies on the front retaining element 5, and the stop surfaces 64 or the corresponding boundary surfaces between the link parts 13 prevent the rear end of the link chain 12 from being able to lie directly on or against the front end of the link chain 12. This prevents impractical positions or inadmissible modes of the binding mechanism 1.

One advantage of stop surfaces 64 of this type for defining the pivot angle or curvature of the binding mechanism 1 is that the curvature of the shoe sole 10 or the sports shoe 2 can also be limited. If different stop surfaces 64 or different stop positions are provided, it is also possible to enable the link chain 12 to assume a more pronounced curvature in some individual part-portions than other part-portions of the link chain 12. For example, by means of a defined disposition of stop surfaces 64, the link chain 12 may curve or be deformable to a more pronounced degree in the front end portion than in its rear portion lying closest to the heel of the sports shoe 2.

Also with the embodiment illustrated in FIG. 8, the link chain 12 may be provided with a spring and restoring means 47 which causes the link chain 12 or its link parts 13 to be constantly forced into a defined initial or non-operating position. In particular, this at least one spring and restoring means 47 causes the connecting element 9 provided in the form of a link chain 12 to assume a substantially longitudinally extending shape or straight line in the non-loaded or force-neutral state. Accordingly, two spring and restoring means 47 provided in the form of a flexible or resilient bar 48 extend parallel with one another. These flexible bars 48 extending through the orifices 51 in the link parts 13 may be provided in the form of coil springs or by bar-type spring elements, which ensure that the link chain 12 is able to assume a defined but flexibly variable shape. Providing the spring and restoring means 47 in the form of a coil spring enables a longitudinal extension of the link chain 12 on the one hand and also enables the link chain 12 to deform or bend virtually unhindered about the individual articulation axes 16.

In another embodiment illustrated in FIG. 7, at least one articulated connection 14 is provided between link parts 13 of the link chain 12 which can be released if necessary and removed and re-connected again when required. It is expedient if this articulated connection 14, which can be released whenever necessary, can be removed by transferring two link parts 13 into a first relative position or angular position 65. It is of advantage if the link chain 12 can be bent downwards or moved downwards for lengthening or shortening purposes, in order to remove or separate at least one articulated connection 14. In particular, the angular position 65 is defined by an angle position which does not occur during ordinary application or use of the binding mechanism 1. Consequently, the link chain 12 can then be separated when the bottom face of the link chain 12 assumes a concave shape relative to the top face of a board-type gliding device. When other relative positions or other angular positions 65 are assumed, the link parts 13 are articulatingly connected to one another and non-releasably coupled with one another in order to afford a mechanical connection between the rear retaining element 6 and the front retaining element 5.

Figure 9:
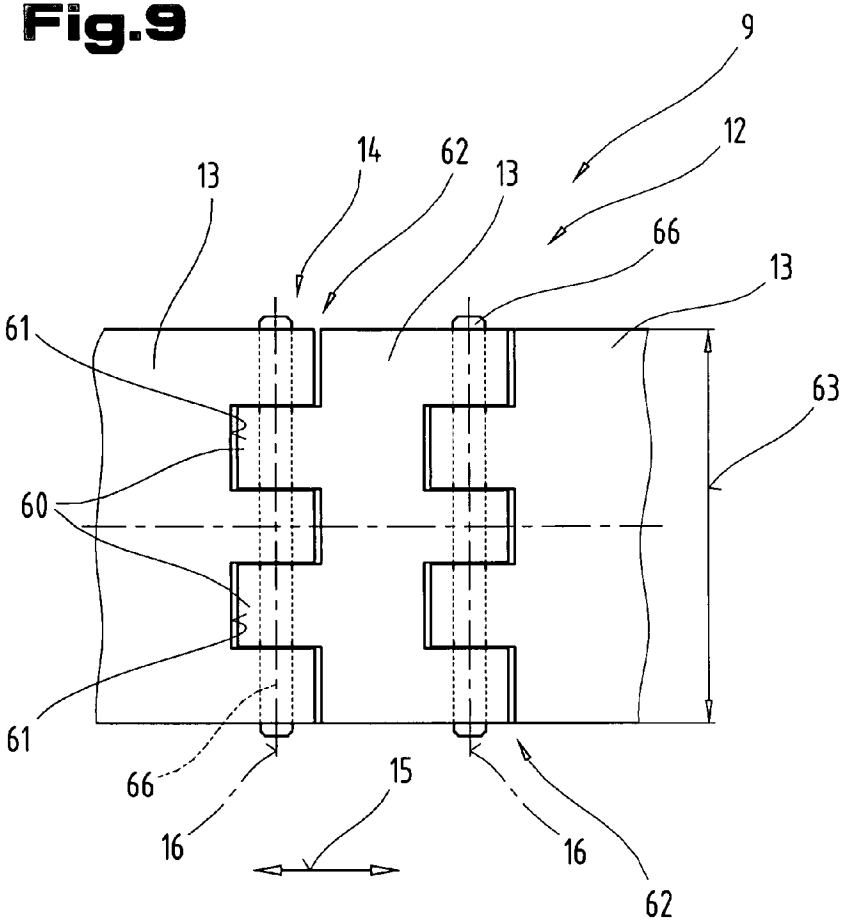
FIG. 9 shows another embodiment of an articulated connecting element for the binding mechanism.

FIG. 9 illustrates an example of another embodiment of a link chain 12 serving as a structural connecting element 9 between a front and a rear retaining element 5, 6 (FIG. 1).

In this instance, the individual link parts 13 disposed in a row are able to engage positively in a meshing arrangement with one another in the binding longitudinal direction—arrow 15. The link joints 14 are provided in the form of bolts 66, which couple consecutive link parts 13 articulatingly with one another. This link chain 12 is provided in the form of a crawler-type plate which is able to bend in several places and is capable of withstanding torsional forces, and which enables relatively high forces to be transmitted between the rear and the front retaining element 5, 6 (FIG. 1). Again, this also enables the link chain 12 to be easily varied in terms of its length. To this end, individual link parts 13 merely have to be added or removed. To this end, one of the link joints 14 is removed by removing one of the bolts 66. The link chain 12 can therefore be easily lengthened or shortened.

Figure 10:
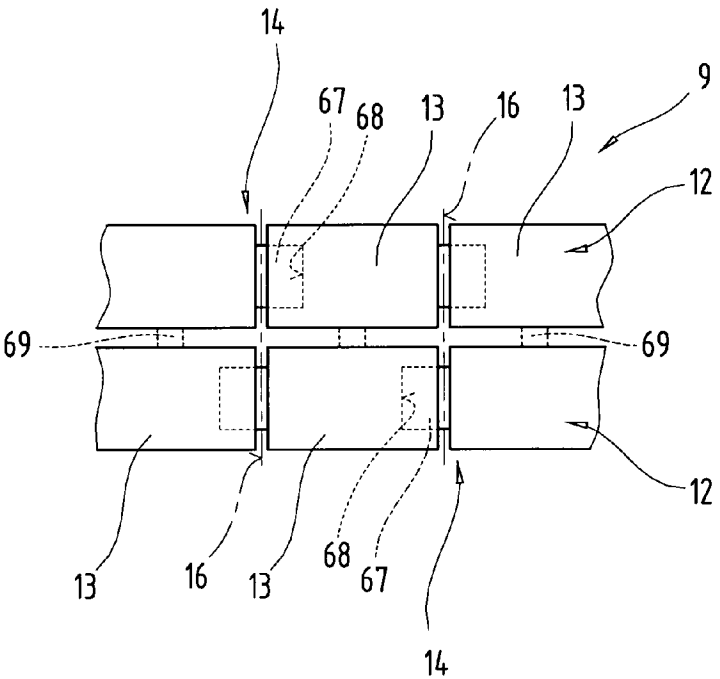
FIG. 10 shows another embodiment of an articulated connecting element between a front and a rear retaining element of the pivotably displaceable binding mechanism.

FIG. 10 illustrates another embodiment of a connecting element 9 or a link chain 12 for mounting between a front and a rear retaining element 5, 6 (FIG. 1). In this instance, two link chains 12 extending essentially parallel with one another are connected in parallel or adjacent to one another. The individual link parts 13 connected to one another by means of link joints 14 have positive snap-fit connections by means of which a link chain 12 made up of several link parts 13 can be made up to the desired length. In particular, projections 67 of a link part 13 with spherically shaped heads engage in matching recesses 68 with a spherical disc shape of a subsequent or next link part 13 in the row.

Mutually parallel link chains 12 may optionally be connected to one another in displacement by transversely extending connecting webs 69, at least in certain portions, in order to increase the strength or torsional strength of the connecting element 9 comprising a plurality of link parts 13.

Instead of two mutually parallel link chains 12, it would also be possible to provide a plurality of link chains 12 disposed parallel with one another. This being the case, the individual link chains 12 may be spaced at a distance apart from one another and connected by means of transversely extending connecting webs 69. However, it would also be possible to opt for a gap-free or space-free parallel arrangement of several link chains 12, in which case the side faces of the individual link chains 12 either lie loosely one against the other or may be connected to one another, at least in certain regions.

The embodiments illustrated as examples represent possible design variants of the binding mechanism 1 or the connecting element 9 but it should be pointed out at this stage that the invention is not restricted to the design variants specifically illustrated, and instead, various combinations of the design variants with one another are possible and these possible variations are within the reach of the person skilled in this field on the basis of the technical teaching described with respect to the subject matter of the invention. Consequently, all conceivable design variants and embodiments which can be obtained by combining individual details of the embodiments described and illustrated are possible and fall within the protective scope of the invention.

For the sake of good order, finally, it should be pointed out that, in order to provide a clearer understanding of the structure of the binding mechanism 1 or connecting element 9, it and its constituent parts are illustrated to a certain extent out of scale and/or on an enlarged scale and/or on a reduced scale The individual embodiments illustrated in FIGS. 1, 2, 3; 4, 5, 6; 7; 8; 9; 10 constitute independent solutions proposed by the invention in their own right. The associated objectives and solutions may be found in the detailed descriptions of these drawings.

List of Reference Numbers

1. Binding mechanism
2. Sports shoe
3. Gliding device
4. Ski
5. First retaining element
6. Second retaining element
7. Retaining clamp
8. Clamp fastener
9. Connecting element
10. Sole
11. Top face
12. Link chain
13. Link part
14. Articulated connection
15. Arrow (binding longitudinal axis)
16. Articulation axis
17. Vertical plane
18. Support element
19. Screw
20. Connection point
21. Initial link
22. Pivot axis
23. Connection point

24. End link
25. Projection
26. Support element
27. Portion
28. Portion
29. Length
30. Curvature
31. Longitudinal extension
32. Longitudinal extension
33. Articulated link
34. Transmission arm
35. Transmission arm
36. Mounting element
37. Link
38. Link
39. Link
40. Link
41. Locking mechanism
42. Locking clamp
43. Active position
44. Catch lug
45. Support body
46. Recess
47. Spring and restoring means
48. Flexible bar
49. Total length
50. Setting mechanism
51. Orifice
52. Receiving or retaining element
53. Thrust bearing
54. Spring element
55. Migrating nut arrangement
56. Longitudinal compensation
57. Pin
58. Cut-out
59. Slot
60. Projection
61. Cut-out
62. Hinge
63. Width
64. Stop surface
65. Angular position
66. Bolt
67. Projection
68. Recess
69. Connecting web

What is claimed is:

1. Binding mechanism to provide a pivoting connection of a sports shoe to a board-type gliding device, in particular to a ski, with a first or front retaining element for retaining the front toe-end portion of a sports shoe, a second or rear retaining element for retaining the rear heel-end portion of a sports shoe, and with an elongate connecting element of variable shape between the first and the second retaining element, which connecting element extends underneath the sole of a sports shoe inserted in the binding mechanism, wherein the connecting element is provided in the form of a link chain with a plurality of connecting link parts, and the individual link parts are articulatingly connected to one another by means of several link joints, which form several articulation axes oriented parallel with one another, and the articulation axes of the link joints are oriented essentially horizontally and extend transversely with respect to the longitudinal axis of the connecting element and transversely to the binding longitudinal axis.

2. Binding mechanism according to claim 1, wherein the link chain comprises at least 3 to approximately 20 link parts.

3. Binding mechanism according to claim 1, wherein the link chain comprises approximately 8 to 12 link parts.

4. Binding mechanism according to claim 1, wherein the link parts of the link chain are of a plate-type design and are dimensionally stable on exposure to the mechanical forces which occur during use of the binding mechanism.

5. Binding mechanism according to claim 1, wherein the individual link parts and link joints of the link chain are designed to be torsionally strong or torsionally stable on exposure to the mechanical forces which occur during use of the binding mechanism.

6. Binding mechanism according to claim 1, wherein at least some link parts of the link chain are of differing lengths.

7. Binding mechanism according to claim 6, wherein the link parts in a portion lying closest to the front retaining element are shorter than the link parts in a portion of the link chain lying closest to the rear retaining element.

8. Binding mechanism according to claim 1, wherein at least one articulated connection is provided between link parts of the link chain and can be released or removed and connected again as and when necessary.

9. Binding mechanism according to claim 8, wherein the articulated connection, which can be released when necessary, can be released by transferring two link parts into a first relative position or angular position and when the link parts assume other relative positions or angular positions, they are articulatingly and non-releasably connected to one another.

10. Binding mechanism according to claim 1, wherein a length of the link parts corresponds to the smallest pitch unit or the smallest jump in size of a standard or standardised shoe size system.

11. Binding mechanism according to claim 1, wherein a length of the link part corresponds to a fraction, for example one half or a third, of the smallest unit of a standard or standardised shoe size system.

12. Binding mechanism according to claim 1, wherein a length of the link part is a multiple of the smallest pitch unit of a shoe size system.

13. Binding mechanism according to claim 1, wherein the connecting element or the link chain can be displaced starting from an essentially longitudinally extending non-operating position into a convexly curved shape with an outwardly arcuate curvature relative to a straight line connecting the front and rear retaining element.

14. Binding mechanism according to claim 1, wherein at least individual link parts have at least one stop surface for restricting or fixing as short as possible a pivot angle between mutually adjacent link parts.

15. Binding mechanism according to claim 1, wherein the connecting element or the link chain is articulated in the front part-portion or in the front part-half of the connecting element and the remaining part-portion or the rear part-half of the connecting element is not articulated.

16. Binding mechanism according to claim 1, wherein the position of the rear retaining element can be varied and fixed relative to the front retaining element.

17. Binding mechanism according to claim 1, wherein the front retaining element has a retaining clamp for accommodating or holding the front portion of a sports shoe.

18. Binding mechanism according to claim 1, wherein a longitudinal extension of the front retaining element is a multiple of a length of a link part of the link chain.

19. Binding mechanism according to claim 1, wherein the front retaining element is connected by means of at least one other articulated link to a plate-type mounting element, which is able to pivot so that it can be secured to a top face of a board-type gliding device.

20. Binding mechanism according to claim 19, wherein the front retaining element is coupled with the mounting element by means of at least two, preferably four, transmission arms and the transmission arms are articulatingly connected on the one hand to the retaining element and on the other hand to the mounting element.

21. Binding mechanism according to claim 20, wherein the transmission arms are oriented so that they cross one another by reference to a vertical plane oriented in the binding longitudinal direction.

22. Binding mechanism according to claim 20, wherein the mutually crossing transmission arms are of differing lengths.

23. Binding mechanism according to claim 19, wherein a locking mechanism which can be activated when necessary is designed to prevent the pivoting movement of the other articulated link.

24. Binding mechanism according to claim 23, wherein the locking mechanism has a pivotably mounted locking clamp which prevents the pivoting movement between the front retaining part and the mounting element and locks the other articulated link when in its active position.

25. Binding mechanism according to claim 1, wherein the connecting element or link chain co-operates with at least one spring and restoring means and the connecting element or link chain is constantly forced into an at least more or less longitudinally extended initial or non-operating position.

26. Binding mechanism according to claim 25, wherein the spring and restoring means is provided in the form of a flexible bar or t least a leaf spring, which is disposed in the core or centre region of the link chain.

27. Binding mechanism according to claim 25, wherein the spring and restoring means extends across at least the entire length of the link chain.

28. Binding mechanism according to claim 25, wherein the at least one spring and restoring means forces the front retaining element and the rear retaining element into a minimum distance from one another restricted by stops.

29. Binding mechanism according to claim 25, wherein a setting mechanism is provided for adjusting the spring force or the rebound force of the spring and restoring means if necessary.

30. Binding mechanism according to claim 1, wherein the articulated connection between two link parts has at least one pin on the first link part which engages in at least one matching cut-out of an aligned second link part.

31. Binding mechanism according to claim 30, wherein the at least one pin of the first link part engages at least in a slot of the other link part oriented in the longitudinal direction of the link chain.

32. Binding mechanism according to claim 1, wherein the link parts assembled to form a link chain have an orifice extending at least in the longitudinal direction of the link chain for receiving a longitudinally flexible bar or spring and restoring means.

33. Binding mechanism according to claim 1, wherein the connecting element or the link chain can be varied in terms of its total length against the spring force of a spring and restoring means.

34. Binding mechanism according to claim 33, wherein the connecting element or link chain is designed to be extendable against the spring force of the spring and restoring means and to rebound elastically.

35. Binding mechanism according to claim 1, wherein the front retaining element is of a pedestal-type design and has at least one connection point for an initial link of the link chain.

36. Binding mechanism according to claim 1, wherein the rear retaining element has at least one connection point to provide a connection with at least one end link of the link chain.

37. Binding mechanism according to claim 1, wherein the link chain has a torsional strength on the one hand and a deformation resistance on the other with respect to lateral deviating movements tantamount to a plate-connection or rigid connection between the front and rear retaining element.

38. Binding mechanism according to claim 1, wherein at least one articulated connection of the link chain enables a rotating and translating movement between two mutually adjacent link parts.

39. Binding mechanism according to claim 1, wherein the link parts are connected to one another by link joints with an exclusively rotating or pivoting degree of freedom.

40. Binding mechanism according to claim 1, wherein at least two mutually parallel link chains are provided.

41. Binding mechanism according to claim 40, wherein the link chains are spaced at a distance apart and are connected to one another by transversely extending connecting webs, at least in certain regions.

42. Binding mechanism according to claim 1, wherein at least one articulated connection between the link parts is provided in the form of a hinge, whereby meshing projections on mutually facing ends of two link parts spaced at a distance apart from one another in the direction of the link axis engage in one another in a meshing arrangement.

43. Binding mechanism according to claim 1, wherein a width of the link chain or the plate-type link parts is at least 15 mm to 60 mm, preferably approximately 30 mm.

44. Binding mechanism according to claim 1, wherein the rear retaining element is forced by the adjustable biasing force of a spring means to a minimum distance from the front retaining element restricted by stops.

* * * * *